US007754297B2

(12) United States Patent
Tsujihata et al.

(10) Patent No.: US 7,754,297 B2
(45) **Date of Patent: *Jul. 13, 2010**

(54) INK JET RECORDING SHEET

(75) Inventors: Shigetomo Tsujihata, Shizuoka-ken (JP); Ryoichi Nakano, Shizuoka-ken (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/715,600

(22) Filed: Nov. 19, 2003

(65) Prior Publication Data

US 2004/0101640 A1 May 27, 2004

(30) Foreign Application Priority Data

Nov. 19, 2002 (JP) ..... 2002-335068

(51) Int. Cl.
*B41M 5/50* (2006.01)

(52) U.S. Cl. ..... 428/32.34; 428/32.38

(58) Field of Classification Search ..... 428/32.29, 428/32.3

See application file for complete search history.

(56) References Cited

U.S. PATENT DOCUMENTS

| | | | | |
|---|---|---|---|---|
| 4,002,594 | A | 1/1977 | Fetterman | |
| 4,543,403 | A | 9/1985 | Isayama et al. | |
| 4,830,911 | A | 5/1989 | Kojima et al. | |
| 4,944,988 | A * | 7/1990 | Yasuda et al. | 428/32.29 |
| 5,306,765 | A | 4/1994 | Kuriyama et al. | |
| 5,985,453 | A | 11/1999 | Moriya et al. | |
| 6,037,050 | A | 3/2000 | Saito et al. | |
| 6,165,606 | A | 12/2000 | Kasahara et al. | |
| 6,500,524 | B2 | 12/2002 | Moriya | |
| 6,635,320 | B2 * | 10/2003 | Wakata et al. | 428/32.26 |
| 6,699,536 | B2 * | 3/2004 | Katoh et al. | 428/32.28 |
| 6,743,850 | B2 * | 6/2004 | Yoshimura et al. | 524/538 |
| 6,773,770 | B1 * | 8/2004 | Sugiyama et al. | 428/32.34 |

FOREIGN PATENT DOCUMENTS

| | | | |
|---|---|---|---|
| EP | 0 379 964 | A1 | 8/1990 |
| EP | 0 627 324 | A1 | 12/1994 |
| EP | 0 835 888 | A2 | 4/1998 |
| EP | 0 870 623 | A1 | 10/1998 |
| EP | 0 970 819 | A2 | 1/2000 |
| EP | 0 983 867 | A | 3/2000 |
| EP | 1 241 193 | A2 | 9/2002 |
| EP | 1 251 013 | A2 | 10/2002 |
| JP | 63-115780 | A | 5/1988 |
| JP | 8-108618 | A | 4/1996 |
| JP | 10-95164 | A | 4/1998 |
| JP | 10-119423 | A | 5/1998 |
| JP | 10-195276 | A | 7/1998 |
| JP | 10-217601 | A | 8/1998 |
| JP | 11-058942 | A | 3/1999 |
| JP | 11-78221 | A | 3/1999 |
| JP | 11-321079 | A | 11/1999 |
| JP | 11-328409 | A | 11/1999 |
| JP | 11-348409 | A | 12/1999 |
| JP | 2000-247021 | A | 9/2000 |
| JP | 2000-313847 | A | 11/2000 |
| JP | 2001-26179 | A | 1/2001 |
| JP | 2001-199153 | A2 | 7/2001 |
| JP | 2001293948 | A | 10/2001 |
| JP | 2002-211119 | A | 7/2002 |
| WO | WO 01/05599 | A1 | 1/2001 |
| WO | WO 02/094573 | A1 | 11/2002 |

OTHER PUBLICATIONS

Patent Abstracts of Japan, abstracting JP-A-2001 010209, Jan. 16, 2001.

Office Action dated Jan. 9, 2007 for JP 2002-335068, Japanese Patent Office.

* cited by examiner

*Primary Examiner*—Bruce H Hess
(74) *Attorney, Agent, or Firm*—Sughrue Mion, PLLC

(57) ABSTRACT

The present invention provides ink jet recording sheets comprising a colorant receiving layer on a substrate, the colorant receiving layer comprising fine particles, a water soluble resin, and a cationic resin including a unit represented by the following formula (1):

Formula (1)

Formula (1)

wherein, R represents a hydrogen atom or a methyl group; Y represents a divalent linking group; $R_1$ represents an optionally substituted aralkyl or aryl group; $R_2$ and $R_3$ each independently represents an optionally substituted alkyl, aralkyl or aryl group having 1 to 18 carbon atoms; $R_4$ represents an optionally substituted alkylene, aralkylene or arylene group; Q is at least one unit provided from a monomer having an ethylenic double bond, and represents a unit having an inorganic/organic ratio (I/O value) of less than 1 in the organic conceptional chart; $X^-$ represents an anion; m represents 20 to 100% by mole; and n represents 0 to 80% by mol.

11 Claims, No Drawings

INK JET RECORDING SHEET

CROSS REFERENCE TO RELATED APPLICATIONS

This application claims benefit of and priority to Japanese Patent Application No. 2002-335068, filed on Nov. 19, 2002, which is incorporated herein by reference in its entirety for all purposes.

BACKGROUND OF THE INVENTION

1. Field of the Invention

The present invention relates to a recording material supplied for ink jet printing using liquid inks such as an aqueous ink (using dyes and pigments as colorants) and oil-based ink, and solid inks that are solids at room temperature and are used for printing by melting and liquefying the ink. Particularly, the invention relates to an ink jet recording sheet being excellent in ink receptivity with little blurring over time in image portions and being excellent in light fastness.

2. Description of the Related Art

Accompanying rapid progress of information technology industries in recent years, various information processing systems have been developed, and recording methods and recording apparatus suitable for the information processing systems also have been developed and made practical.

Among these recording methods, ink jet recording methods have come to be widely used for office as well as home use because of their advantages of printability property on various kinds of recording materials, relatively low-cost hardware and compact size, and excellent quietness.

Since resolution of the ink jet printer has increased in recent years, obtaining "photorealistic" high quality outputs has became possible, and various kinds of ink jet recording sheets have been developed with such improvement of hardware (printers).

Required characteristics for these ink jet printing sheets are generally: (1) rapid drying (rapid ink-absorption speed), (2) proper and uniform diameter of ink dots (no blurring), (3) good granularity, (4) high circularity of dots, (5) high color density, (6) high chroma (free of dullness), (7) good water resistance, light fastness and ozone resistance of printed portions, (8) high brightness of recording sheets, (9) good preservability of recording sheets (no yellow coloring or blurring of images in a long term preservation (excellent in prevention of blurring over time)), (10) substantially no deformation with good dimensional stability (sufficiently small curling), and (11) good runnability of hardware.

In the usage of photographic glossy paper sheets used for obtaining photorealistic high quality printed material, in addition to the carious aforementioned characteristics, the recording sheets are also required to have glossiness, glossiness of printed portions, surface smoothness and texture of printed paper sheets resembling that of silver salt photographs.

For improving the characteristics described above, ink jet recording sheets having a porous structure in the colorant receiving layer have been developed and made practical in recent years. Such ink jet recording sheets are endowed with excellent ink receptivity (rapidly drying property) and high glossiness by having the porous structure.

For example, Japanese Patent Application Laid-Open (JP-A) Nos. 10-119423 and 10-217601 have proposed ink jet recording sheets comprising fine inorganic pigment particles and a water soluble resin, wherein a colorant receiving layer having a high void ratio is provided on a substrate.

These recording sheets, particularly the ink jet recording sheet having the colorant receiving layer comprising the porous structure using silica as the inorganic pigment particles, are, because of their structure, excellent in ink absorbing properties while having high ink receptivity and high glossiness that enable high resolution images to be formed.

However, since these sheets have high oxygen permeability due to their porous coated layers, deterioration of components involved in the colorant receiving layer may be enhanced. Furthermore, the images may blur over time (referred to as time-dependent blurring hereinafter) as water is adsorbed on the silica surface.

In contrast, an ink jet recording material using cationic resins has been proposed for preventing time-dependent blurring from occurring (JP-A Nos. 2001-26179 and 11-78221). However, these recording materials have not possessed the porous structure using fine particles.

Recording materials having colorant receiving layers comprising the porous structure using fine particles are described in JP-A Nos. 10-217601, 63-115780, 11-321079 and 11-328409. However, the cationic resins used in these publications are not always satisfactory for preventing time-dependent blurring from occurring.

SUMMARY OF THE INVENTION

Accordingly, it is an object of the present invention to attain the following objects by solving the conventional problems described above. The invention provides an ink jet recording sheet capable of forming high resolution images at high density, being excellent in light fastness, and generating no time-dependent blurring even when long term stored in a high temperature/high humidity environment after printing, enabling images to be stably preserved.

The inventors have determined that an ink jet recording sheet, in which the (meth)acrylate cationic resins described below are contained in a color accepting layer disposed on a substrate, solves the above problems and thus completed the invention.

A first aspect of the invention is to provide an ink jet recording sheet comprising a colorant receiving layer disposed on a substrate, wherein the colorant receiving layer contains fine particles, a water soluble resin, and at least one of a cationic resin including a unit represented by the following formula (1) and a cationic resin including a unit represented by the following formula (2):

Formula (1)

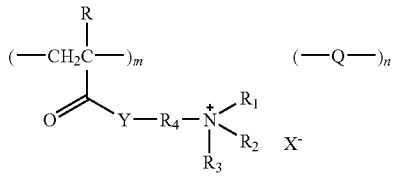

Formula (2)

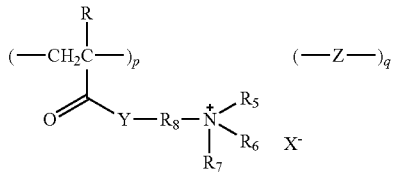

in the formula (1), R represents a hydrogen atom or a methyl group; Y represents a divalent linking group; $R_1$ represents an optionally substituted aralkyl or aryl group; $R_2$ and $R_3$ each independently represents an optionally substituted alkyl, aralkyl or aryl group having 1 to 18 carbon atoms; $R_4$ represents an optionally substituted alkylene, aralkylene or arylene group; Q is at least one unit provided from a monomer having an ethylenic double bond, and represents a unit having an inorganic/organic ratio (I/O value) of less than 1 in the organic conceptional chart; $X^-$ represents an anion; m represents 20 to 100% by mole; and n represents 0 to 80% by mole; and in the formula (2), R represents a hydrogen atom or a methyl group; Y represents a divalent linking group; $R_5$, $R_6$ and $R_7$ each independently represents an optionally substituted alkyl group having 1 to 18 carbon atoms; $R_8$ represents an optionally substituted alkylene, aralkylene or arylene group; Z is at least one unit provided from an aromatic group-containing monomer having an ethylenic double bond, and represents a unit having an inorganic/organic ratio (I/O value) of less than 0.5 in the organic conceptional chart; $X^-$ represents an anion; p represents 20 to 80% by mole; and q represents 20 to 80% by mole.

A second aspect of the invention may be to provide the ink jet recording sheet according to the first aspect, wherein the colorant receiving layer comprises a cationic resin including the unit represented by the formula (1).

A third aspect of the invention may be to provide the ink jet recording sheet according to the first aspect, wherein the colorant receiving layer comprises a cationic resin including the unit represented by the formula (2).

A fourth aspect of the invention is to provide the ink jet recording sheet, wherein the monomer that provides the unit represented by Q or Z in the formula (1) or (2), respectively, is styrene or vinyl toluene.

A fifth aspect of the invention is to provide the ink jet recording sheet, wherein the I/O value of the cationic resin represented by the formula (1) or (2) is not more than 2 with a cation equivalent of at least 1.5 meq/g or more and no more than 4 meq/g.

A sixth aspect of the invention is to provide the ink jet recording sheet, wherein the fine particles are at least one selected from silica fine particles, colloidal silica, alumina fine particles and pseudo-boehmite.

A seventh aspect of the invention is to provide the ink jet recording sheet, wherein the water soluble resin is at least one selected from polyvinyl alcohol resins, cellulose resins, resins having ether bonds, resins having carbamoyl groups, resins having carboxyl groups and gelatin.

An eighth aspect of the invention is to provide the ink jet recording sheet, wherein the colorant receiving layer comprises a cross-linking agent capable of cross-linking the water soluble resin.

A ninth aspect of the invention is to provide the ink jet recording sheet, wherein the colorant receiving layer further comprises a dye mordant.

A tenth aspect of the invention is to provide the ink jet recording sheet, wherein the colorant receiving layer is obtained by hardening by crosslinking a coated layer prepared by coating the substrate with a coating liquid containing at least the fine particles, the water soluble resin, and a cationic resin including a unit represented by the formula (1) or a cationic resin including a unit represented by the formula (2), and the coated layer is hardened by cross-linking by adding a cross-linking agent to at least one of the coating liquid and a basic solution having a pH value of at least 8, and by applying the basic solution to the coated layer (1) at the same time as when the coated layer is formed by applying the coating liquid or (2) during the process for drying the coated layer formed by applying the coating liquid, and before the coated layer exhibits a falling rate of drying.

DETAILED DESCRIPTION OF THE INVENTION

The ink jet recording sheet of the present invention comprises fine particles, a water soluble resin, and a cationic resin represented by formula (1) or (2) formed on a colorant receiving layer on a substrate.

Cationic Resin

Cationic Resin Including a Unit Represented by the Formula (1)

One of the cationic resins of the invention contained in the colorant receiving layer has a unit represented by the formula (1):

Formula (1)

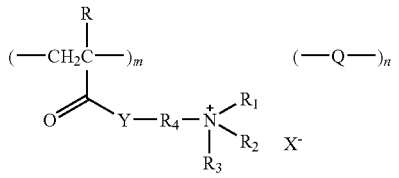

In the formula (1), R represents a hydrogen atom or a methyl group; Y represents a divalent linking group; $R_1$ represents an optionally substituted aralkyl or aryl group; $R_2$ and $R_3$ each independently represents an optionally substituted alkyl, aralkyl or aryl group having 1 to 18 carbon atoms; $R_4$ represents an optionally substituted alkylene, aralkylene or arylene group; Q is at least one unit provided from a monomer having an ethylenic double bond, and represents a unit having an inorganic/organic ratio (I/O value) of less than 1 in the organic conceptional chart; $X^-$ represents an anion; m represents 20 to 100% by mole; and n represents 0 to 80% by mole.

The compound is described in detail below.

$R_1$ represents an aralkyl or aryl group that may have substituents. Examples of the optionally substituted aralkyl group include a benzyl group, phenylethyl group, vinylbenzyl group and hydroxyphenyl methyl group. Examples of the optionally substituted aryl group include a phenyl group, alkylphenyl group (for example, a methylphenyl group, ethylphenyl group, n-propylphenyl group and n-butylphenyl group), naphthyl group, chlorophenyl group, dichlorophenyl group, trichlorophenyl group, bromophenyl group, hydroxydiphenyl group, methoxyphenyl group, acetoxyphenyl group and cyanophenyl group. The benzyl group, phenylethyl group, phenyl group and naphthyl group are preferable among them.

$R_2$ and $R_3$ independently represent optionally substituted alkyl, aralkyl and aryl groups having 1 to 18 carbon atoms. Examples of the alkyl group include a methyl group, ethyl group, n-propyl group, isopropyl group, n-butyl group, isobutyl group, t-butyl group, n-hexyl group, cyclohexyl group, 2-ethylehxyl group, n-octyl group, n-nonyl group, n-decyl group, n-dodecyl group, n-octadecyl group, hydroxyethyl group and 1-hydroxypropyl group. Examples of the aralkyl and aryl group include the same groups as exemplified in $R_1$. The methyl group, ethyl group, n-propyl group, n-butyl group and benzyl group are preferable among them.

$R_4$ represents an optionally substituted alkylene group (for example a methylene group, ethylene group, trimethylene group, 2-hydroxypropylene group and hexamethylene group), aralkylene group (for example a benzylidene group), and arylene group (for example a phenylen group).

Y represents a divalent linking group, and examples thereof include —O— and —NR'— groups. Examples of R' include hydrogen or alkyl group (for example a methyl group, ethyl group, n-propyl group, n-butyl group and n-hexyl group).

Q represents at least one unit provided from a monomer having an ethylenic double bond, and represents a unit having an inorganic/organic ratio (I/O value) of less than 1 in the organic conceptional chart. Examples of the monomer include (meth)acrylic acid alkyl esters [for example, esters of (meth)acrylic acid having 1 to 18 carbon atoms, such as methyl (meth)acrylate, ethyl (meth)acrylate, propyl (meth) acrylate, isopropyl (meth)acrylate, n-butyl (meth)acrylate, isobutyl (meth)acrylate, t-butyl (meth)acrylate, hexyl (meth) acrylate, octyl (meth)acrylate, 2-hexylethyl (meth)acrylate, and lauryl (meth)acrylate, and stearyl (meth)acrylate], cycloalkyl esters of (meth)acrylic acid [for example cyclohexyl (meth)acrylate], aryl esters of (meth)acrylic acid [for example phenyl (meth)acrylate], aralkyl esters [for example benzyl (meth)acrylate], aromatic vinyl compounds (for example styrene, vinyltoluene and α-methyl styrene), vinyl esters (for example vinyl acetate, vinyl propionate and vinyl versatate), ally esters (for example allyl acetate), halogen-containing monomers (for example vinylidene chloride and vinyl chloride), vinyl cyanate (for example (meth)acrylonitrile), and olefins (for example ethylene and propylene).

Monomers having the inorganic/organic ratio (I/O value) of less than 0.5 in the organic conceptional chart (for example styrene, vinyl toluene, t-butyl methacrylate, hexyl methacrylate, cyclohexyl methacrylate, 2-ethylhexyl (meth)acrylate and benzyl (meth)acrylate) are preferable, and styrene and vinyl toluene are particularly preferable.

The I/O value as used herein refers to a parameter representing a scale of a hydrophilicity/hydrophobicity ratio of a compound or a substituent, as described in detail in "*Yuki Gainen Zu* (Organic Conceptional Chart)", written by Yoshio Koda, Sankyo Publishing Co., 1984. "I" represents the inorganic and "O" represents the organic, and the lager I/O means a larger inorganic (higher polarity and larger hydrophilicity).

Either one kind of the monomer or two or more kinds of copolymerizable monomers may be used. While m is in the range of 20 to 100% by mole, a range of 30 to 70% by mole is preferable. While n is in the range of 0 to 80% by mole, a range of 30 to 70% by mole is preferable.

$X^-$ represents an anion, and examples thereof include halogen ions ($Cl^-$, $Br^-$, $I^-$), sulfonic acid ions, alkylsulfonic acid ions, arylsulfonic acid ions, alkyl carboxylic acid ions and aryl carboxylic acid ions. Cationic resin including a unit represented by formula (2)

The other cationic resin included in the colorant receiving layer of the invention has a unit represented by the following formula (2):

Formula (2)

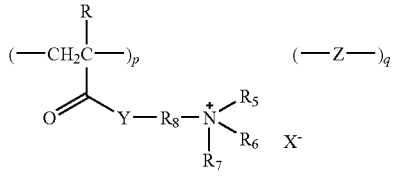

In the formula (2), R represents a hydrogen atom or a methyl group; Y represents a divalent linking group; $R_5$, $R_6$ and $R_7$ each independently represents an optionally substituted alkyl group having 1 to 18 carbon atoms; $R_8$ represents an optionally substituted alkylene, aralkylene or arylene group; Z is at least one unit provided from an aromatic group-containing monomer having an ethylenic double bond, and represents a unit having an inorganic/organic ratio (I/O value) of less than 0.5 in the organic conceptional chart; $X^-$ represents an anion; p represents 20 to 80% by mole; and q represents 20 to 80% by mole.

$R_5$, $R_6$ and $R_7$ each independently represents an optionally substituted alkyl group having 1 to 18 carbon atoms. Examples of the alkyl group in $R_2$ and $R_3$ are also valid for the alkyl groups above. $R_8$ represents an alkylene group, aralkylene group and arylene group, which are identical to those in $R_4$.

Z means at least one unit provided from an aromatic group-containing monomer having ethylenic double bonds, and represents a unit having an inorganic/organic ratio (I/O value) of less than 0.5 in the organic conceptional chart. Preferable examples of the monomer that provides the unit include styrene, vinyl toluene and benzyl (meth)acrylate.

One of these copolymerizable components may be used, or at least two of them may be combined.

While p is in the range of 20 to 80% by mole, a range of 30 to 70% by mole is preferable. While q is in the range of 20 to 80% by mole, a range of 30 to 70% by mole is preferable.

The molecular weight of the polymer represented by the formula (1) or (2) is preferably 1,000 to 500,000, more preferably 2,000 to 100,000, as the weight average molecular weight. Water resistance becomes insufficient when the molecular weight is less than 1,000 to make it impossible to suppress time-dependent blurring of the image. Handling performance becomes poor when the molecular weight is larger than 500,000.

While the polymer represented by the formula (1) or (2) is preferably soluble in water, or an organic solvent compatible with water, the polymer may be used as a water dispersible latex.

The structure and contents of copolymerization components of the polymer represented by the formula (1) or (2) are preferably selected so that the inorganic/organic ratio (I/O value) in the organic conceptional chart not more than 2, and the cation equivalent is 1.5 to 4 meq/g. The effect for preventing time-dependent blurring may be insufficient due to too high solubility of the cationic resin in water, when the I/O value is larger than 2. The proportion of the dye mordant part becomes relatively small to insufficiently fix a dye, when the cation equivalent is less than 1.5 meq/g, while dispersability of the coating liquid is deteriorated when the cation equivalent is larger than 4 meq/g.

The cation equivalent as used herein means the equivalent (mmol) of the cationic group (the sum of the amino groups and ammonium groups) contained per 1 g of the polymer, and is represented by meq/g.

Preferable examples of the cationic resin represented by the formula (1) or (2) are shown below:

P-1

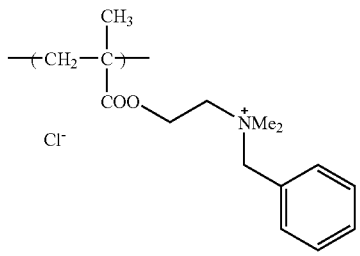

-continued
P-2
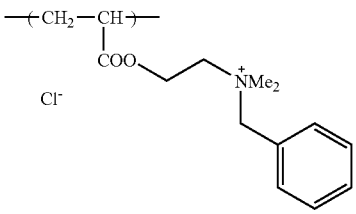
P-3
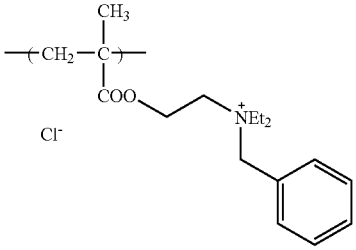
P-4
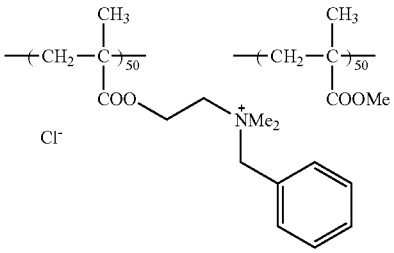
P-5
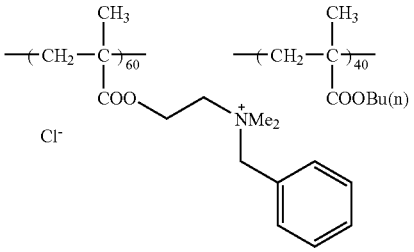
P-6
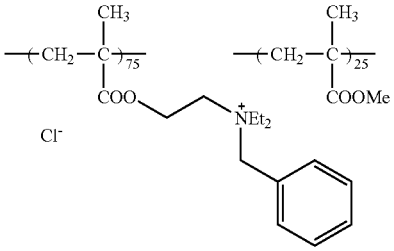
P-7
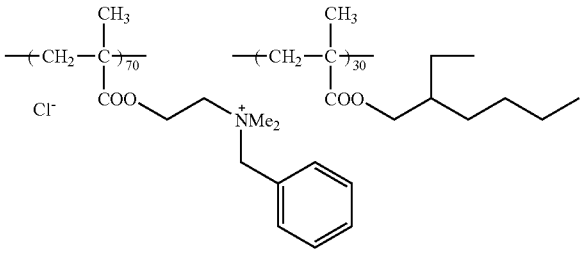
-continued
P-8
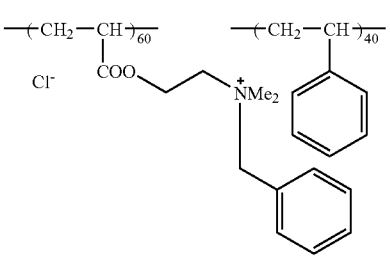
P-9
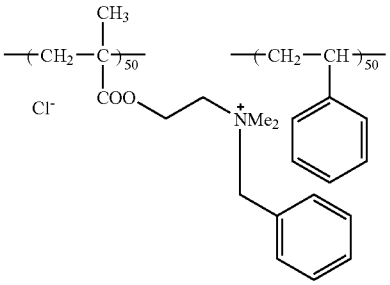
P-10
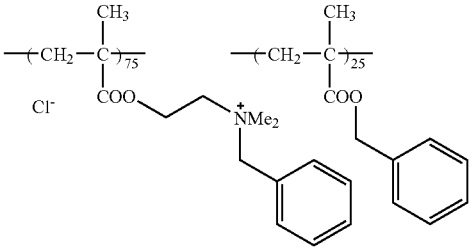
P-11
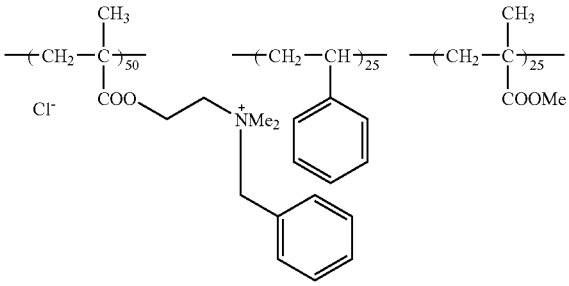
P-12
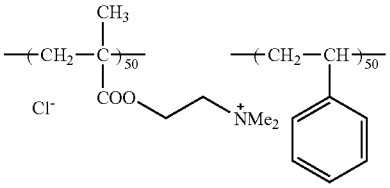
P-13
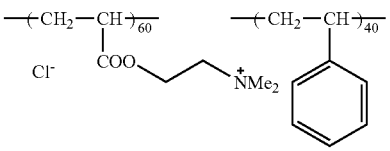

-continued

P-14

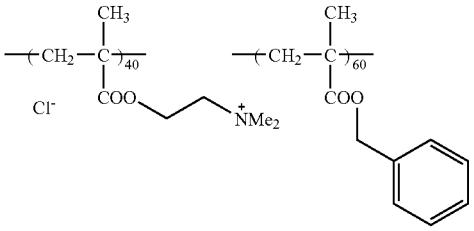

P-15

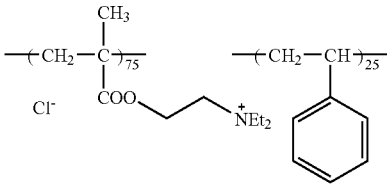

P-16

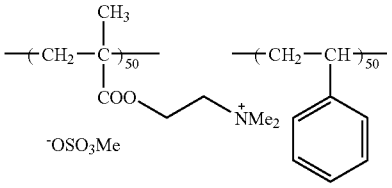

P-17

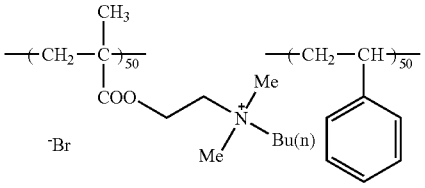

P-18

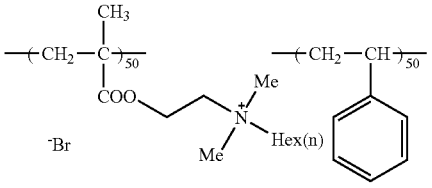

P-19

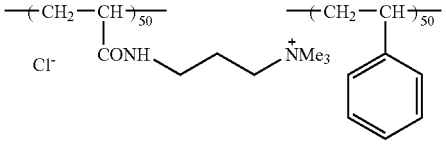

The cationic resin represented by the formula (1) or (2) can be produced by a radical polymerization of a cationic vinyl polymer, or by a radical copolymerization of the cationic vinyl polymer with a monomer copolymerizable with the cationic vinyl polymer. Examples of the cationic monomer include 2-(methacryloyloxy)ethyltrimethyl ammonium chloride (for example, trade name: DQ-100, manufactured by Kyoeisha Chemical Co., Ltd.; trade name: methacrylate DMC-80, manufactured by Sanyo Chemical Industries, Ltd.), and 2-(acryloyloxy)ethyltrimethyl ammonium chloride (for example, trade name: methacrylate SMC-80, manufactured by Sanyo Chemical Industries, Ltd.), 2-(methacryloyloxy) ethyl-N,N-dimethylbenzyl ammonium chloride (for example, trade name: acrylic ester DML-60, manufactured by Mitsubishi Rayon Co., Ltd.).

The cationic resin including the unit represented by the formula (1) or (2) can be produced by converting a polymer obtained by a radical polymerization of a monomer having a tertiary amino group, or by a radical copolymerization of a polymer of the polymer above with a copolymerizable monomer, into a quaternary ammonium compound. Examples of the monomer having the tertiary amino group include N,N-dimethylaminoethyl (meth)acrylate, N,N-diethylaminoethyl (meth)acrylate, N,N-dimethylaminopropyl (meth)acrylate, N,N-diethylaminopropyl (meth)acrylate, N,N-dimethylaminoethyl (meth)acrylamide, N,N-diethylaminoethyl (meth) acrylamide, N,N-dimethylaminopropyl (meth)acrylamide, and N,N-diethylaminopropyl (meth)acrylamide. The polymer of the invention can be obtained by converting the polymer having the unit comprising any one of these monomers into a ternary compound with an alkyl halide (for example methyl chloride, methyl bromide, methyl iodide, ethyl chloride, ethyl bromide, propyl bromide, n-butyl bromide, n-hexyl bromide, cyclohexyl bromide, n-octyl bromide, 2-ethylhexyl bromide, and dodecyl bromide).

A counter-ion of the polymer produced above may be exchanged with a salt such as an aryl sulfonic acid salt, alkyl sulfonic acid salt and alkyl carboxylic acid salt.

The total content of the cationic resin including the unit represented by the formula (1) or (2) in the ink jet recording sheet is preferably 0.01 to 5 g/m$^2$, more preferably 0.1 to 3 g/m$^2$. The effect for preventing time-dependent blurring may be insufficient when the total content is less than 0.01 g/m$^2$, while ink absorbing property may be decreased when the total content exceeds 5 g/m$^2$.

Fine Particles

The colorant receiving layer of the ink jet recording sheet of the invention contains fine particles.

The colorant receiving layer of the ink jet recording sheet acquires a porous structure by containing the fine particles to thereby improve ink absorbing performance. In particular, the solid contents exceeding 50% by mass, more preferably 60% by mass, in the colorant receiving layer of the fine particles is preferable, since an ink jet recording sheet having a sufficient ink absorbing property is obtained by enabling a better porous structure to be formed. The solid contents in the colorant receiving layer of the fine particles is calculated herein based on the components in the composition constituting the colorant receiving layer except water.

While the fine particles used in the invention are preferably inorganic fine particles, organic fine particles may be used so long as the particles do not impair the effect of the invention.

Preferable organic fine particles include polymer fine particles obtained by emulsion polymerization, micro-emulsion polymerization, soap-free polymerization, seed polymerization, dispersion polymerization and suspension polymerization, for example polymer fine particles such as powder, latex and emulsion of polyethylene, polypropylene, polystyrene, polyacrylate, polyamide, silicon resin, phenol resin and natural polymer.

Examples of the inorganic fine particles include silica fine particles, colloidal silica, titanium dioxide, barium sulfate, calcium silicate, zeolite, kaolinite, halloysite, mica, talc, calcium carbonate, magnesium carbonate, calcium sulfate, pseudo-boehmite, zinc oxide, zinc hydroxide, alumina, aluminum silicate, calcium silicate, magnesium silicate, zirconium oxide, zirconium hydroxide, cerium oxide, lanthanum oxide, and yttrium oxide. Silica fine particles, colloidal silica, alumina fine particles and pseudo-boehmite is preferable among them from the viewpoint of forming a good porous structure. The fine particles may be used as primary particles, or after forming secondary particles. The average primary particle diameter of these fine particles is preferably 2 μm or less, more preferably 200 nm or less.

Furthermore, silica fine particles with an average primary particle diameter of 20 nm or less, colloidal silica with an average primary particle diameter of 30 nm or less, alumina fine particles with an average primary particle diameter of 20 nm or less, and pseudo-boehmite with an average fine pore diameter of 2 to 15 nm are more preferable, and the silica fine particles, alumina fine particles and pseudo-boehmite are particularly preferable.

The silica fine particles are roughly classified into wet method particles and dry method (gas phase method) particles depending on their production method. In the prevailing wet method, active silica is formed by acidolysis of a silicate salt, and active silica is appropriately polymerized to obtain hydrated silica by coagulation and precipitation. In contrast, anhydrous silica is obtained by hydrolysis of silicon halide in a gas phase at a high temperature (flame hydrolysis method), or silica sand and coke are vaporized by reduction by heating with arc in an electric furnace, and the product thereof is oxidized with air (arc method) in the prevailing gas phase method. The "gas phase silica" means anhydrous silica fine particles obtained by the gas phase method. The silica fine particles by the gas phase method are particularly preferable as the silica fine particles used in the invention.

Although the gas phase silica exhibits different properties from hydrated silica due to the difference of the density of the silanol groups on the surface and the proportion of the voids, the gas phase silica is suitable for forming a three-dimensional structure having a high void ratio. While the reason thereof is not clear, the density of the silanol groups on the surface of the fine particles is as large as 5 to 8 pieces/$nm^2$ in hydrated silica to make the silica particles to be readily aggregated. In contrast, the density of the silanol group on the surface of the fine particles is supposed to be as small as 2 to 3 groups/$nm^2$ in gas phase silica to form coarse and soft flocculates, thereby forming a structure having a high void ratio.

Since gas phase silica has a particularly large surface area, the efficiency for absorbing and retaining an ink becomes high. In addition, the colorant receiving layer becomes transparent by dispersing the particles having a proper particle diameter since the refractive index of gas phase silica is low, thereby exhibiting characteristics for enabling a high color density and good coloring property to be obtained. It is important for obtaining a high color density and good glossiness of colors that the color receiving layer is transparent not only in the uses requiring high transparency such as an OHP film, but also in an application as a recording sheet such as a photographic glossy paper sheet.

The average primary particle diameter of gas phase silica is preferably 30 nm or less, more preferably 20 nm or less, particularly 10 nm or less, and most preferably 3 to 10 nm. Since the gas phase silica particles are liable to be coagulated with each other due to the hydrogen bond between the silanol groups, a structure having a large void ratio may be formed when the average primary particle diameter is 30 nm or less, and ink absorbing characteristics may be effectively improved.

The silica fine particles may be used together with other fine particles. The content of gas phase silica is preferably 30% by mass or more, more preferably 50% by mass or more, when the gas phase silica particles are used together with other fine particles.

Alumina fine particles, alumina hydrate, and a mixture or composite thereof are also preferable as the inorganic fine particles used in the invention. The alumina hydrate is preferable among them since it is able to favorably fix the ink by absorbing the ink, and pseudo-boehmite ($Al_2O_3.nH_2O$) is particularly preferable. While various forms of the alumina hydrate may be used, boehmite sol is preferably used as the material since a smooth surface can be readily obtained.

The fine void structure of pseudo-boehmite has an average fine void diameter of preferably 1 to 30 nm, more preferably 2 to 15 nm. The fine void volume is preferably 0.3 to 2.0 cc/g, more preferably 0.5 to 1.5 cc/g. The fine void diameter and fine void volume are measured by a nitrogen absorption-desorption method using, for example, a gas absorption-desorption analyzer (for example, trade name: Omnisorp 369, manufactured by Beckman Coulter, Inc.).

The gas phase alumina fine particles are preferable among the alumna fine particles due to a large surface area. The average primary particle diameter of gas phase alumina is preferably 30 nm or less, more preferably 20 nm or less.

Embodiments disclosed in JP-A Nos. 10-81064, 10-119423, 10-157277, 10-217601, 11-348409, 2001-138621, 2000-43401, 2000-211235, 2000-309157, 2001-96897, 2001-138627, 11-91242, 8-2087, 8-2090, 8-2091, 8-2093, 8-174992, 11-192777 and 2001-301314 can be also preferably used when the fine particles are used for the ink jet recording sheet.

Water Soluble Resin

The ink jet recording sheet of the invention further contains a water soluble resin in the colorant receiving layer.

Examples of the water soluble resin include resins having hydroxyl groups as hydrophilic structural units such as polyvinyl alcohol resins [polyvinyl alcohol (PVA), acetoacetyl modified polyvinyl alcohol, cation modified polyvinyl alcohol, anion modified polyvinyl alcohol, silanol modified polyvinyl alcohol and polyvinyl acetal], cellulose resins [methyl cellulose (MC), ethyl cellulose (EC), hydroxyethyl cellulose (HEC), carboxymethyl cellulose (CMC), hydroxypropyl cellulose (HPC), hydroxyethylmethyl cellulose, and hydroxypropylmethyl cellulose], chitin, chitosan, and starch; resins having ether bonds [polyethylene oxide (PEO), polypropylene oxide (PPO), polyethylene glycol (PEG), and polyvinyl ether (PVE)]; and resins having carbamoyl groups [polyacrylamide (PAAM), polyvinyl pyrrolidone (PVP) and polyacrylic acid hydrazide].

The other examples include polyacrylic acid salts, maleic acid resins, alginic acid salts and gelatin having carboxylic groups as dissociation groups.

The polyvinyl alcohol resins are particularly preferable among the resin above. Examples of the polyvinyl alcohol resins are described in Japanese Patent Application Publication (JP-B) Nos. 4-52786, 5-67432 and 7-29479, Japanese Patent No. 2537827, JP-B No. 7-57553, Japanese Patent Nos. 2502998 and 3053231, JP-A No. 63-176173, Japanese Patent No. 2604367, JP-A Nos. 7-276787, 9-207425, 11-58941, 2000-135858, 2001-205924, 2001-287444, 62-278080 and 9-39373, Japanese Patent No. 2750433, JP-A Nos. 2000-158801, 2001-213045, 2001-328345 and 8-324105, 11-348417.

Examples of the water soluble resin other than the polyvinyl alcohol resins are the compounds described in paragraph Nos. [0011] to [0014] in JP-A No. 11-165461.

These water soluble resins may be used alone, or as a combination of at least two of them.

The content of the water soluble resin of the invention is preferably 9 to 40% by mass, more preferably 12 to 33% by mass, relative to the mass of the total solid fraction of the colorant receiving layer.

The water soluble resin and the fine particles mainly constituting the colorant receiving layer of the invention may comprise respective single materials, or a mixed material of a plurality of materials.

The kind of the water soluble resin combined with the fine particles, particularly silica fine particles, is important from the viewpoint of maintaining transparency. Polyvinyl alcohol resins are preferable as the water soluble resin when gas phase silica is used, and the polyvinyl alcohol resin preferably has a degree of saponification of 70 to 100%, more preferably 80 to 99.5%.

Since the polyvinyl alcohol resin has hydroxyl groups in its structural unit, a three dimensional network structure having the secondary particles of the silica fine particles as a network chain unit may be readily formed by forming hydrogen bonds between the hydroxyl group and silanol group on the surface of the silica fine particles. The colorant receiving layer having a porous structure with a high void ratio and sufficient strength is considered to be formed by forming the three dimensional network structure.

The porous colorant receiving layer obtained as described above rapidly absorbs the ink by a capillary action during the ink jet recording process, and dots having a good circularity may be formed without causing blurring of the ink.

The polyvinyl alcohol resin may be used together with other water soluble resins. The content of the polyvinyl alcohol resin is preferably 50% by mass or more, more preferably 70% by mass or more, in the total content of the water soluble resins, when the polyvinyl alcohol resin is used together with other water soluble resins.

Composition Ratio between Fine Particles and Water Soluble Resin

The mass composition ratio [PB ratio (x/y)] between the proportions of the fine particles (x) and water soluble resin (y) greatly affects the layer structure of the colorant receiving layer and strength of the layer. In other words, while the void ratio, fine void volume and surface area (per unit mass) tend to be larger by increasing the mass content ratio [PB ratio], the density and strength rather are decreased.

The mass Composition ratio [PB ratio (x/y)] of the colorant receiving layer of the invention is preferably 1.5 to 10, for preventing decrease of the layer strength and cracks by drying ascribed to too large PB ratio, and for preventing the tendency of blocking of the voids with the resin and decrease of ink absorbing ability due to decrease of the void ratio when the PB ratio is too small.

The colorant receiving layer should have a sufficient strength since the recording sheet may suffer a stress by passing through a convey system of an ink jet printer. The colorant receiving layer should also have a sufficient strength for preventing cracks and peeling of the colorant receiving layer from being generated when the recording sheet is cut into smaller sheets. The mass ratio (x/y) is preferably 5 or less considering the cases above, while the ratio is preferably 2 or more from the viewpoint of ensuring high speed ink absorption in the ink jet printer.

The three dimensional network structure comprising the network chains of the secondary particles of the silica fine particles is formed, when a coating liquid comprising the gas phase silica fine particles having an average primary particle diameter of 20 nm or less and water soluble resin perfectly dispersed in an aqueous solution are applied on a substrate at a mass ratio (x/y) of 2 to 5 followed by drying the coated layer. Then, a light permeable porous layer may be readily formed with an average fine void diameter of 30 nm or less, a void ratio of 50 to 80%, a fine void volume of 0.5 ml/g or more, and a specific surface area of 100 $m^2/g$ or more.

Cross-linking Agent

In the embodiment of the color receiving layer of the ink jet recording sheet of the invention, the coated layer containing the fine particles and water soluble resin preferably contains a cross-linking agent capable of cross-linking the water soluble resin, and the porous layer is hardened by the cross-linking reaction between the cross-linking agent and water soluble resin.

Boron compounds are preferably used for cross-linking of the water soluble resin, particularly polyvinyl alcohol resin. Examples of the boron compound include borax, boric acid, borate (for example orthoborate, $InBO_3$, ScBO3, $YBO_3$, $LaBO_3$, $Mg_3(BO_3)_2$ and $CO_3(BO_3)_2$), diborate (for example $Mg_2B_2O_5$, $CO_2B_2O_5$), methaborate (for example $LiBO_2$, $Ca(BO_2)_2$, $NaBO_2$ and $KBO_2$), tetraborate (for example $Na_2B_4O_7.10H_2O$), and pentaborate (for example $KB_5O_8.4H_2O$, $Ca_2B_6O_{11}.7H_2O$, and $CsB_5O_5$). Borax, boric acid and borates are preferable for permitting the cross-linking reaction to be promptly induced, and boric acid is particularly preferable.

The following compounds other than the boron compounds may be used as the cross-linking agent of the water soluble resin.

The compounds are, for example, aldehyde compounds such as formaldehyde, glyoxal and glutaraldehyde; ketone compounds such as diacetyl and cyclopentanedione; active halogen compounds such as bis(2-chloroethylurea)-2-hydroxy-4,6-dichloro-1,3,5-triazine, 2,4-dichloro-6-triazine sodium salt; active vinyl compounds such as divinyl sulfonic acid, 1,3-divinylsulfonyl-2-propanol, N,N'-ethylenebis(vinylsulfonylacetamide), and 1,3,5-triaclyroyl-hexahydro-S-triazine; N-methylol compounds such as dimethylol urea, and methylol dimethylhydantoin; melamine resins (for example methylolmelamine, alkylated methylolmelamine; and epoxy resins.

Other examples of the compounds include isocyanate compounds such as 1,6-hexamethylene diisocyanate; aziridine compounds described in U.S. Pat. Nos. 3,017,280 and 2,983,611; carboxyimide compounds described in U.S. Pat. No. 3,100,704; epoxy compounds such as glycerol triglycidyl ether; ethyleneimino compounds such as 1,6-hexamethylene-N,N'-bisethyleneurea; halogenated carboxyaldehyde compounds such as mucochloric acid and mucophenoxy chloric acid; dioxane compounds such as 2,3-dihydroxydioxane; metal containing compounds such as titanium lactate, aluminum sulfonate, chromium alum, potassium alum, zirconium acetate and chromium acetate; polyamine compounds such as tetraethylene pentamine; hydrazide compounds such as hydrazine adipate; and low molecular weight compounds and polymers having at least two oxazoline groups.

One of the cross-linking agents may be used alone, or the cross-linking agents may be used as a combination thereof.

Preferably, the water soluble resin is hardened by cross-linking by the steps comprising adding a cross-linking agent to a coating liquid containing fine particles, the water soluble resin and the like (referred to as "coating liquid A" hereinafter) and/or to the basic solution below; and applying a basic solution having a pH value of at least 8 (referred to as "coating liquid B" hereinafter) to the coated layer either (1) at the same time as when the coated layer is formed by coating the coating liquid, or (2) during the step for drying the coated layer formed by coating the coating liquid and before the coated layer exhibits a falling rate of drying. The cross-linking agent is preferably applied as follows in the examples of boron compounds. When the colorant receiving layer is prepared by hardening by cross-linking the coated layer comprising the coating liquid (coating liquid A) containing a water soluble resin containing fine particles and polyvinyl alcohol, the water soluble resin is hardened by cross-linking by applying the basic solution (coating liquid B) having a pH value of at least 8 to the coated layer either (1) at the same time as when the coated layer is formed by coating the coating liquid, or (2) during the step for drying the coated layer formed by coating the coating liquid and before the coated layer exhibits a falling rate of drying. The boron compound as the cross linking agent may be contained in either the coating liquid A or coating liquid B, or in both the coating liquid A and coating liquid B.

The amount of use of the cross-linking agent is preferably 1 to 50% by mass, more preferably 5 to 40% by mass, relative to the water soluble resin.

Dye Mordant

The dye mordant is preferably contained in the colorant receiving layer for improving water resistance and time-dependent blurring of the image formed.

The dye mordant is preferably a cationic polymer (cationic mordant dye) as an organic mordant, or an inorganic mordant. Presence of the dye mordant in the colorant receiving layer permits colorant to be stabilized by an interaction between the dye mordant and a liquidous ink comprising an anionic dye as the colorant, thereby permitting water resistance and time-dependent blurring resistance to be improved. Each of the organic mordant and inorganic mordant may be used alone, or the organic mordant and inorganic mordant may be used together.

Polymer mordants having primary to tertiary amino groups, or quaternary ammonium group as cationic groups are usually used as the cationic mordants. However, cationic non-polymer mordants may be also used in the invention.

Examples of the polymer mordant include homopolymers of monomers (mordant monomers) comprising the primary to tertiary amino groups and salts thereof or quaternary ammonium salts, and copolymers or condensed polymers between the dye mordant monomer and other monomers (referred to as "non-mordant monomer" hereinafter). These polymer mordants may be used either as water soluble polymers or water dispersible latex particles.

Examples of the monomer (mordant monomer) include trimethyl-p-vinylbenzyl ammonium chloride, trimethyl-m-vinylbenzyl ammonium chloride, triethyl-p-vinylbenzyl ammonium chloride, triethyl-m-vinylbenzyl ammonium chloride, N,N-dimethyl-N-ethyl-N-p-vinylbenzyl ammonium chloride, N,N-diethyl-N-methyl-N-p-vinylbenzyl ammonium chloride, N,N-dimethyl-N-n-propyl-N-p-vinylbenzyl ammonium chloride, N,N-dimethyl-N-n-octyl-N-p-vinylbenzyl ammonium chloride, N,N-dimethyl-N-benzyl-N-p-vinylbenzyl ammonium chloride, N,N-diethyl-N-benzyl-N-p-vinylbenzyl ammonium chloride, N,N-dimethyl-N-(4-methyl) benzyl-N-p-vinylbenzyl ammonium chloride, and N,N-dimethyl-N-phenyl-N-p-vinylbenzyl ammonium chloride;

trimethyl-p-vinylbenzyl ammonium bromide, trimethyl-m-vinylbenzyl ammonium bromide, trimethyl-p-vinylbenzyl ammonium sulfonate, trimethyl-m-vinylbenzyl ammonium sulfonate, trimethyl-p-vinylbenzyl ammonium acetate, trimethyl-m-vinylbenzyl ammonium acetate, N,N,N-triethyl-N-2-(4-vinylphenyl)ethyl ammonium chloride, N,N,N-triethyl-N-2-(3-vinylphenyl)ethyl ammonium chloride, N,N-diethyl-N-methyl-N-2-(4-vinylphenyl)ethyl ammonium chloride, and N,N-diethyl-N-methyl-N-2-(4-vinylphenyl)ethyl ammonium acetate; and quaternary compounds of N,N-dimethylaminoethyl (meth)acrylate, N,N-diethylaminoethyl (meth)acrylate, N,N-dimethylaminopropyl (meth)acrylate, N,N-diethylaminopropyl (meth)acrylate, N,N-dimethylaminoethyl (meth)acrylamide, N,N-diethylaminoethyl (meth)acrylamide, N,N-dimethylaminopropyl (meth)acrylamide, and N,N-diethylaminopropyl (meth)acrylamide with methyl chloride, ethyl chloride, methyl bromide, ethyl bromide, methyl iodide or ethyl iodide; and salts of sulfonic acid, alkyl slfonic acid, acetic acid or alkyl carboxylic acid prepared by substituting the anions of the compounds above.

Further examples of the monomer include monomethyl-diallyl ammonium chloride, trimethyl-2-(methacryloyloxy) ethyl ammonium chloride, triethyl-2-(methacryloyloxy)ethyl ammonium chloride, trimethyl-2-(acryloyloxy)ethyl ammonium chloride, triethyl-2-(acryloyloxy)ethyl ammonium chloride, trimethyl-3-(methacryloyloxy)propyl ammonium chloride, triethyl-3-(methacryloyloxy)propyl ammonium chloride, trimethyl-2-(methacryloylamino)ethyl ammonium chloride, triethyl-2-(methacryloylamino)ethyl ammonium chloride, trimethyl-2-(acryloylamino)ethyl ammonium chloride, triethyl-2-(acryloylamino)ethyl ammonium chloride, trimethyl-3-(methacryloylamino)propyl ammonium chloride, trethyl-3-(methacryloylamino)propyl ammonium chloride, trimethyl-3-(acryloylamino)propyl ammonium chloride, and triethyl-3-(acryloylamino)propyl ammonium chloride; and N,N-dimethyl-N-ethyl-2-(methacryloyloxy)ethyl ammonium chloride, N,N-diethyl-N-methyl-2-(methacryloyloxy) ethyl ammonium chloride, N,N-dimethyl-N-ethyl-3-(acryloylamino)propyl ammonium chloride, trimethyl-2-(methacryloyloxy)ethyl ammonium bromide, trimethyl-3-(acryloylamino)propyl ammonium bromide, trimethyl-2-(methacryloyloxy)ethyl ammonium sulfonate, and trmethyl-3-(acryloylamino)propyl ammonium acetate.

Other copolymerizable monomers include N-vinyl imidazole and N-vinyl-2-methyl imidazole.

The non-mordant monomers refer to monomers containing no primary to tertiary amino groups and salts thereof, or no basic or cationic portions such as quaternary ammonium salts, and do not interact, or has a substantially small interaction, with the dyes in the ink jet ink.

Examples of the non-mordant monomers include (meth) acrylic acid alkyl esters; (meth)acrylic acid cycloalkyl esters such as cyclohexyl (meth)acrylate; (meth)acrylic acid aryl esters such as phenyl (meth)acrylate; aralkyl esters such as benzyl (meth)acrylate; aromatic vinyl compounds such as styrene, vinyl toluene and α-methyl styrene; vinyl esters such as vinyl acetate, vinyl propionate and vinyl versatate; allyl esters such as allyl acetate; halogenated monomers such as vinylidene chloride and vinyl chloride; vinyl cyanate such as (meth)acrylonitrile; and olefins such as ethylene and propylene.

(Meth)acrylic acid alkyl esters with a carbon number of the alkyl portion of 1 to 18 are preferable as the (meth)acrylic acid alkyl esters, and examples thereof include methyl (meth) acrylate, ethyl (meth)acrylate, propyl (meth)acrylate, isopropyl (meth)acrylate, n-butyl (meth)acrylate, isobutyl (meth) acrylate, t-butyl (meth)acrylate, hexyl (meth)acrylate, octyl (meth)acrylate, 2-ethylhexyl (meth)acrylate, lauryl (meth) acrylate, and stearyl (meth)acrylate.

Methyl acrylate, ethyl acrylate, methyl methacrylate, ethyl methacrylate and hydroxyethyl methacrylate are preferable among them.

The non-mordant monomers may be used alone, or as a combination of at least two of them.

Further examples of the polymer mordant include polydiallyldimethyl ammonium chloride; polymethacryloyloxyethyl-β-hydroxyethyl dimethylammonium chloride; polyethylene imine; polyallylamine and derivatives thereof; polyamide-polyamine resins; cationic starch; dicyan cationic resins represented by dicyan-diamide formalin condensates, dimethyl-2-hydroxypropyl ammonium polymers, polyamidine, polyvinyl amine, and dicyanamindiamide-formalin polycondensates; polyamine cationic resins represented by dicyanamide-diethylene triamine polycondensates; epichlorohydrin-dimethylamine addition polymer; dimethyl hypophosphite ammonium chloride-$SO_2$ copolymer; diallylamine salt-$SO_2$ copolymer; polymer containing (meth)acrylate having quaternary ammonium salt substituted alkyl group at the ester part; and styryl polymer having quaternary ammonium salt substituted alkyl group.

The preferable organic mordant of the invention is polyallylamine with a weight average molecular weight of 100,000 or less from the viewpoint of preventing time-dependent blurring.

Inorganic mordants may be used as the dye mordant of the invention, and examples thereof include salts of polyfunctional water soluble metals and hydrophobic metal chlorides.

Examples of the inorganic mordant include salts or complexes of the metals selected from magnesium, aluminum, calcium, scandium, titanium, vanadium, manganese, iron, nickel, copper, zinc, gallium, germanium, strontium, yttrium, zirconium, molybdenum, indium, barium, lanthanum, cerium, praseodymium, neodymium, samarium, europium, gadolinium, dysprosium, erbium, ytterbium, hafnium, tungsten and bismuth.

Specific examples include calcium acetate, calcium chloride, calcium formate, calcium sulfate, barium acetate, barium sulfate, barium phosphate, manganese chloride, manganese acetate, manganese formate dihydrate, manganese ammonium sulfate hexahydrate, copper (II) chloride, ammonium copper (II) chloride dihydrate, copper sulfate, cobalt chloride, cobalt thiocyanate, cobalt sulfate, nickel sulfate hexahydrate, nickel chloride hexahydrate, nickel acetate tetrahydrate, nickel ammonium sulfate hexahydrate, nickel amidesulfate tetrahydrate, aluminum sulfate, aluminum alum, basic polyhydroxy aluminum, aluminum sulfite, aluminum thiosulfate, aluminum polychloride, aluminum nitrate nanohydrate, aluminum chloride hexahydrate, iron (I) bromide, iron (I) chloride, iron (II) chloride, iron (I) sulfate, iron (II) sulfate, zinc phenolsulfonate, zinc bromide, zinc chloride, zinc nitrate hexahydrate, zinc sulfate, titanium tetrachloride, tetraisopropyl titanate, titanium acetylacetonate, titanium lactate, zirconium acetylacetonate, zirconium acetate, zirconium sulfate, zirconium ammonium carbonate, zirconyl stearate, zirconyl octylate, zirconyl nitrate, zirconium oxychloride, zirconium hydroxychloride, chromium acetate, chromium sulfate, magnesium sulfate, magnesium sulfate hexahydrate, magnesium citrate nanohydrate, sodium phosphotungstate, sodium tungsten citrate, 12-tungstophosphate n-hydrate, 12-tungustosilisic acid 26 hydrate, molybdenum chloride, 12-molybdophosphate n-hydrate, gallium nitrate, germanium nitrate, strontium nitrate, yttrium acetate, yttrium chloride, yttrium nitrate, indium nitrate, lanthanum nitrate, lanthanum chloride, lanthanum acetate, lanthanum benzoate, cerium chloride, cerium sulfate, cerium octylate, praseodymium nitrate, neodymium nitrate, samarium nitrate, europium nitrate, gadolinium nitrate, dysprosium nitrate, erbium nitrate, ytterbium nitrate, hafnium chloride and bismuth nitrate.

Aluminum containing compounds, titanium containing compounds, zirconium containing compounds and metallic compounds (salts or complexes) in group IIIB in the periodic table are preferable as the inorganic mordant of the invention.

The amount of the dye mordant contained in the colorant receiving layer of the invention is preferably 0.01 to 5 g/m$^2$, more preferably 0.1 to 3 g/m$^2$.

Other Components

The ink jet recording sheet of the invention may contain, if necessary, various additives known in the art, for example an acid, a UV ray absorber, an antioxidant, a fluorescent brightener, monomers, a polymerization initiator, a polymerization inhibitor, a blurring preventive agent, an antiseptic, a viscosity stabilizer, a defoaming agent, a surfactant, an antistatic agent, a matting agent, a curl preventive agent, and water resistant agent.

The colorant receiving layer of the invention may contain an acid. The surface of the colorant receiving layer is preferably adjusted to pH 3 to 8, preferably 5 to 7.5, by adding the acid, because resistance to yellow coloring of the white base portion may be improved. The surface pH is measured by Method A (coating method) of the surface pH measurement method prescribed by the Japan Technical Association of the Pulp and Paper Industry (J. TAPPI). For example, the measurement can be performed using a paper sheet pH measuring set type MPC manufactured by KYORITSU CHEMICAL-CHECK Lab., Corp., which corresponds to method A above.

Examples of the acid include formic acid, acetic acid, glycolic acid, oxalic acid, propionic acid, malonic acid, succinic acid, adipic acid, maleic acid, malic acid, tartaric acid, citric acid, benzoic acid, phthalic acid, isophthalic acid, glutaric acid, gluconic acid, lactic acid, aspartic acid, glutamic acid, salicylic acid, salicylic acid metal salts (Zn, Al, Ca and Mg salts), methanesulfonic acid, itaconic acid, benzenesulfonic acid, toluenesulfonic acid, trifluoromethane sulfonic acid, styrene sulfonic acid, trifluoroacetic acid, barbituric acid, acrylic acid, methacrylic acid, cinnamic acid, 4-hydroxybenzoic acid, aminobenzoic acid, naphthalene disulfonic acid, hydroxybenzene sulfonic acid, toluene sulfinic acid, benzene sulfinic acid, sulfanilic acid, sulfamic acid, α-resorcinic acid, β-resorcinic acid, γ-resorcinic acid, gallic acid, fuloroglycine, sulfosalicylic acid, ascorbic acid, erythotbic acid, bisphenolic acid, hydrochloric acid, nitric acid, sulfuric acid, phosphoric acid, polyphosphoric acid, boric acid, and boronic acid. These acid may be added so that surface pH of the colorant receiving layer becomes 3 to 8.

The acids may be used as metal salts (for example sodium, potassium, calcium, cesium, zinc, copper, iron, aluminum, zirconium, lanthanum, yttrium, magnesium, strontium, and cerium salts), or as amine salts (for example ammonia, triethylamine, tributyl amine, piperazine, 2-methylpiperazine and polyallyl amine salts).

The colorant receiving layer preferably contains preservation improving agents such as a UV ray absorber, an antioxidant and a blurring preventive agent.

Examples of these UV ray absorbers, antioxidants and blurring preventive agents include alkylated phenol compounds (including hindered phenol compounds), alkylthiomethyl phenol compounds, hydroquinone compounds, alkylated hydroquinone compounds, tocopherol compounds, thiodiphenyl ether compounds, compounds at least two thioether bonds, bisphenol compounds, O-, N- and S-benzyl compounds, hydroxybenzyl compounds, triazine compounds, phosphonate compounds, acylaminophenol compounds, ester compounds, amide compounds, ascorbic acid, amine antioxidant, 2-(2-hydroxyphenyl)benzotriazole compounds, 2-hydroxybenzophenone compounds, acrylate, water soluble or hydrophobic metal salts, organometallic compounds, metal complexes, hindered amine compounds (including TEMPO compounds), 2-(2-hydroxyphenyl)-1,3,5-triazine compounds, metal inactivating compounds, phosphite compounds, phosphonite compounds, hydroxyamine compounds, nitron compounds, peroxide scavengers, polyamide stabilizers, polyether compounds, basic auxiliary stabilizers, nucleation agents, benzofuranone compounds, indolinone compounds, phosphine compounds, polyamine compounds, thiourea compounds, urea compounds, hydrazide compounds, amidine compounds, saccharide compounds, hydroxybenzoic acid compounds, dihydroxybenzoic acid compounds, and trihydroxybenzoic acid compounds.

The alkylated phenol compounds, compounds having at least two thioether bonds, bisphenol compounds, ascorbic acid, amine antioxidants, water soluble or hydrophobic metal salts, organometallic compounds, metal complexes, hindered amine compounds, hydroxyamine compounds, polyamine compounds, thiourea compounds, hydrazide compounds, hydroxybenzoic acid compounds, dihydroxybenzoic acid compounds, and trihydroxybenzoic acid compounds are preferable among the compounds above.

Specific examples of the compounds above are described in Japanese Patent Application No. 2002-13005, JP-A Nos. 10-182621 and 2001-260519, JP-B Nos. 4-34953 and 4-34513, JP-A No. 11-170686, JP-B No. 4-34512, EP No. 1138509, JP-A Nos. 60-67190, 7-276808, 2001-94829, 47-10537, 58-111942, 58-212844, 59-19945, 59-46646, 59-109055 and 63-53544, JP-B Nos. 36-10466, 42-26187, 48-30492, 48-31255, 48-41572, 48-54965 and 50-10726, U.S. Pat. Nos. 2,719,086, 3,707,375, 3,754,919 and 4,220,711;

in JP-B Nos. 45-4699 and 54-5324, EP Laid-Open Nos. 223739, 309401, 309402, 310551, 310552 and 459416, German Patent Laid-Open No. 3435443, JP-A Nos. 54-48535, 60-107384, 60-107383, 60-125470, 60-125471, 60-125472, 60-287485, 60-287486, 60-287487, 60-287488, 61-160287, 61-185483, 61-211079, 62-146678, 62-146680, 62-146679, 62-282885, 62-262047, 63-051174, 63-89877, 63-88380, 66-88381 and 63-113536; and in JP-A Nos. 63-163351, 63-203372, 63-224989, 63-251282, 63-267594, 63-182484, 1-239282, 2-262654, 2-71262, 3-121449, 4-291685, 4-291684, 5-61166, 5-19449, 5-188687, 5-188686, 5-110490, 5-1108437 and 5-170361, JP-B Nos. 48-43295 and 48-33212, and U.S. Pat. Nos. 4,814,262 and 4,980,275.

The other components as described above may be used alone, or at least two of them may be used together. The other components may be added by solubilizing or dispersing, by dispersing in a polymer, or as an emulsion or oil droplets. Alternatively, the components may be enclosed in microcapsules. The amount of addition of the other components is preferably 0.01 to 10 g/m$^2$ in the ink jet recording sheet of the invention.

The surface of the inorganic fine particles may be treated with a silane coupling agent in order to improve dispensability of the inorganic fine particles. The silane coupling agent preferably comprises organic functional groups [for example vinyl group, amino group (primary to tertiary amino groups, or quaternary ammonium group), epoxy group, mercapto group, chloro group, alkyl group, phenyl group and ester group] in addition to the portions involved in the silane coupling treatment.

The coating liquid (coating liquid A) for the color receiving layer of the invention preferably contains a surfactant. The surfactant available include any one of cationic, anionic, nonionic, amphoteric, fluorine and silicone surfactants.

Examples of the nonionic surfactant include polyoxyalkylene alkyl ethers and polyoxyalkylene alkylphenyl ethers (for example diethyleneglycol monoethyl ether, diethyleneglycol diethyl ether, polyoxyethylene lauryl ether, polyoxyethylene stearyl ether, polyoxyethylene nonylphenyl ether), oxyethylene-oxypropylene block copolymers and sorbitan fatty acid esters (for example sorbitan monolaurate, sorbitan monooleate and sorbitan trioleate), polyoxyethylene sorbitan fatty acid esters (for example polyoxyethylene sorbitan monolaurate, polyoxyethylene sorbitan monooleate, polyoxyethylene sorbitan trioleate), polyoxyethylene sorbitol fatty acid esters (for example tetraoleic acid polyoxyethylene sorbit), glycerin fatty acid esters (for example glycerol monooleate), polyoxyethylene glycerin fatty acid esters (for example monostearic acid polyoxyethylene glycerin and monoleic acid polyoxyethylene glycerin), polyoxyethylene fatty acid esters (for example polyethyleneglycol monolaurate and polyethyleneglycol monooleate), polyoxyethylene alkyl amines, and acetylene glycols (for example 2,4,7,9-tetramethyl-5-decine-4,7-diol and ethylene oxide adducts and propylene oxide adducts of the diol). Polyoxyalkylene alkyl ethers are preferable among them. The nonionic surfactant may be used in both coating liquids A and B. The nonionic surfactants may be used alone, or at least two of them may be used together.

Examples of the amphoteric surfactants include those of amino acid type, carboxyamonium betaine type, sulfoammonium betaine type, ammonium sulfonic ester betaine type and imidazolium betaine type, and those described in U.S. Pat. No. 3,843,368, JP-A Nos. 59-49535, 63-236546, 5-303205, 8-262742 and 10-282619 may be favorably used. Amphoteric surfactants of the amino acid type are preferable as the amphoteric surfactant, which are derived from amino acids (such as glycine, glutamic acid and histidine) as described in JP-A No. 5-303205. An example thereof is N-aminoacyl acid in which a long chain acyl group is introduced and the salt thereof. The amphoteric surfactants may be used alone, or as a combination of at least two of them.

Examples of the anionic surfactants include fatty acid salts (for example sodium stearate and potassium oleate), salts of alkylsulfuric acid ester (for example sodium lauryl sulfate and triethanolamine lauryl sulfate), sulfonic acid slats (for example sodium dodecylbenzene sulfonate), alkylsulfosuccinic acid salts (for example sodium dioctylsulfosuccinate), alkyldiphenylether disulfonic acid salts, and alkylphosphoric acid salts.

Examples of the cationic surfactants include alkylamine salts, quaternary ammonium salts, pyridinium salts and imidazolium salts.

Examples of the fluorine containing surfactants include a compound derived via an intermediate having perfluoroalkyl groups using any one of electrolytic fluorination, teromerization and origomerization methods.

Examples of the fluorine containing surfactants include perfluoroalkyl sulfonic acid salts, perfluoroalkyl carboxylic acid salts, perfluoroalkyl ethylene oxide adducts, perfluoroalkyl trialkyl ammonium salts, perfluoroalkyl group containing oligomers, and perfluoroalkyl phosphoric acid esters.

The silicon surfactant is preferably a silicone oil modified with an organic group, which may have a structure comprising side chains of a siloxane structure modified with the organic group, a structure having modified both terminals, and a structure having a modified terminal. Examples of modification with the organic group include amino modification, polyether modification, epoxy modification, carboxyl modification, carbinol modification, alkyl modification, aralkyl modification, phenol modification and fluorine modification.

The content of the surfactant in the invention is preferably 0.001 to 2.0%, more preferably 0.01 to 1.0%, relative to the coating liquid (coating liquid A) for the colorant receiving layer. When the colorant receiving layer is formed by applying at least two coating liquids, the surfactant is preferably added to respective coating liquids.

The colorant receiving layer preferably contains a high boiling point organic solvent for preventing the colorant receiving layer from curling. The high boiling point organic solvent is a water soluble or hydrophobic organic compound having a boiling point of 150° C. or more at an atmospheric pressure. The solvent may be a liquid or solid at room temperature, and may be a high molecular weight or low molecular weight compound.

Examples of the high boiling point organic solvent include aromatic carboxylic acid esters (such as dibutyl phthalate, diphenyl phthalate and phenyl benzoate), aliphatic carboxylic acid esters (such as dioctyl adipate, dibutyl sebacate, methyl stearate, dibutyl maleate, dibutyl fumarate and triethyl acetylcitrate), phosphoric acid esters (such as trioctyl phosphate and tricresyl phosphate), epoxy compounds (such as epoxylated soybean oil and epoxylated fatty acid methyl ester), alcohols (such as stearyl alcohol, ethyleneglycol, propyleneglycol, diethyleneglycol, triethyleneglycol, glycerin, diethyleneglycol monobutyl ether (DEGMBE), triethyleneglycol monobutyl ether, glycerin monomethyl ether, 1,2,3-butanetriol, 1,2,4-butanetriol, 1,2,4-pentanetriol, 1,2,6-hexanetriol, thiodiglycol, triethanolamine and polyethylene glycol), vegetable oils (such as soybean oil and sunflower oil), and higher aliphatic carboxylic acids (such as linolic acid and oleic acid).

Substrate

Any one of the substrates made of transparent materials such as plastics and opaque substrates made of opaque materials such as paper sheets may be used as the substrate of the invention. The transparent substrates or opaque substrates with high glossiness are preferably used for taking advantage of transparency of the colorant receiving layer.

The materials used for the transparent substrate are preferably transparent and resistant to radiant heat generated suffered in uses in an OHP and backlight display. The preferable materials thereof include polyesters such as polyethylene terephthalate; polysulfone, polyphenylene oxide, polyimide, polycarbonate and polyamide. Polyesters are preferable, and polyethylene terephthalate is particularly preferable among them.

While the thickness of the substrate is not particularly restricted, it is preferably 50 to 200 μm from the viewpoint of handling performance.

The highly glossy and opaque substrate preferably has a glossiness of 40% or more on the surface on the side having the colorant receiving layer. The glossiness is measured according to the method (75 degree specular glossiness test method for paper and paper board). Examples of the highly glossy and opaque substrate are as follows.

They are, for example, highly glossy paper substrates such as art paper, coat paper, cast-coat paper, and barite paper used for silver salt photographic substrate; highly glossy films made to be opaque by adding a white pigment and the like in plastic films such as polyesters such as polyethylene terephthalate (PET), cellulose esters such as nitrocellulose, cellulose acetate and cellulose acetate butylate, polysulfone, polyphenylene oxide, polyimide, polycarbonate and polyamide (a calender treatment may be applied on the surface); and substrates having coated layers of polyolefin containing or not containing the white pigment on the surfaces of the various paper substrates, transparent substrates and highly glossy films containing the white pigment.

Foamed polyester films containing the white pigment (for example foamed PET that contains polyolefin fine particles, and in which voids are formed by stretching) are also favorably used. Resin coat paper used for the silver salt photographic printing paper is also favorably used.

While the thickness of the opaque substrate is not particularly restricted, it is preferably 50 to 300 μm considering handling performance.

A corona discharge treatment, glow discharge treatment, flame treatment or UV irradiation treatment may be applied on the surface of the substrate for improving wettability and adhesive property.

The raw paper sheet used for resin coat paper will be described in detail below.

The raw paper is produced using a wood pulp as a major material, and by adding a synthetic pulp such as polypropylene pulp, or synthetic fibers such as nylon or polyester fibers, into the wood pulp, if necessary. While any one of LBKP, LBSP, NBKP, NBSP, LDP, NDP, LUKP and NUKP may be used as the wood pulp, LBKP, NBSP, LBSP, NDP and LDP abundant in short fibers are preferably used.

However, the proportion of LBS and/or LDP is preferably 10% by mass or more and 70% by mass or less.

Chemical pulps (sulfate pulp and sulfite pulp) containing few impurities are preferably used, and the pulp having improved brightness by applying a bleaching treatment is also useful.

A sizing agent such as a higher fatty acid and alkylketene dimer; white pigment such as calcium carbonate, talc and titanium oxide; a paper strength enhancer such as starch, polyacrylamide and polyvinyl alcohol; a fluorescent brightener; a humectant such as polyethyleneglycol; a dispersing agent; and a softening agent such as quaternary ammonium may be appropriately added in the raw paper sheet.

The degree of water filtration of the pulp used is 200 to 500 ml as defined in CFS. The fiber length after beating is defined as a value measured by a sieve classification method known in the art, and the sum of the percentage by mass of the 24 mesh filtration residue and the percentage by mass of the 42 mesh filtration residue is preferably 30 to 70% by mass. The percentage by mass of the 4 mesh filtration residue is preferably 20% by mass or less.

The average weight of the raw paper sheet is preferably 30 to 250 g/m$^2$, particularly 50 to 200 g/m$^2$. The thickness of the raw paper is preferably 40 to 250 μm. The raw paper sheet may be highly lubricated by applying a calender treatment during the paper making process of after the paper making process. The density of the raw paper is usually 0.7 to 1.2 g/m$^2$.

The rigidity of the raw paper is preferably 20 to 200 g.

A surface sizing agent may be applied on the surface of the raw paper sheet, and the same sizing agent as added in the raw paper sheet may be used as the surface sizing agent.

The pH of the raw paper sheet is preferably 5 to 9 as measured by a hot water extraction method.

While polyethylene used for coating the surface and back face of the raw paper sheet is low density polyethylene (LDPE) and/or high density polyethylene (HDPE), LLDPE, polypropylene and the like may be partly used.

Titanium oxide of rutile or anatase type, fluorescent brightener and ultramarine blue are preferably added into the polyethylene layer that forms the colorant receiving layer to improve obliqueness, whiteness and hue, as widely used in photographic printing paper. The content of titanium oxide is preferably in the range of 3 to 20% by mass, more preferably 4 to 13% by mass, relative to polyethylene. While the thickness of the polyethylene layer is not particularly restricted, the thickness is favorably 10 to 50 μm on both the surface and back face. An undercoat layer may be provided on the polyethylene layer for endowing the layer with an adhesive property to the colorant receiving layer. Aqueous polyethylene, gelatin and PVA are preferably used as the undercoat layer. The thickness of the undercoat layer is preferably 0.01 to 5 μm.

The polyethylene coated paper sheet may be used as glossy paper, or by forming a matte surface or silky surface that are obtainable in usual photographic printing paper sheets by applying an embossing treatment when polyethylene is coated on the raw paper sheet by melt-extrusion.

A back coat layer may be provided on the substrate, and examples of the components capable of adding to the back coat layer include a white pigment, aqueous binder and the like.

Examples of the white pigment contained in the back coat layer include inorganic white pigments such as light calcium carbonate, heavy calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudo-boehmite, aluminum hydroxide, alumina, ritpon, zeolite, hydrated halloysite, magnesium carbonate and magnesium hydroxide; and organic pigments such as styrene plastic pigments, acrylic plastic pigments, polyethylene, microcapsules, urea resin and melamine resin.

Examples of the aqueous binders used for the back coat layer include water soluble polymers such as styrene/maleic acid copolymer, styrene/acrylate copolymer, polyvinyl alcohol, silanol modified polyvinyl alcohol, starch, cation starch, casein, gelatin, carboxymethyl cellulose, hydroxyethyl cellulose and polyvinyl pyrrolidone; and water dispersible polymers such as styrene-butadiene latex and acrylic emulsion.

Other components contained in the back coat layer include defoaming agents, foaming suppressing agents, dyes, fluorescent brighteners, antiseptics and water-proofing agent.

Production of Ink Jet Recording Sheet

The colorant receiving layer of the ink jet recording paper of the invention is preferably formed, for example, by coating the coating liquid A containing at least the fine particles and water soluble resin on the surface of the substrate, and applying the coating liquid B having a pH value of at least 8 (1) at the same time as when the coated layer is formed by applying the coating liquid or (2) during the process for drying the coated layer formed by applying the coating liquid, and before the coated layer exhibits a falling rate of drying, followed by hardening by cross linking the coated layer formed by applying the coating liquid B. The cationic resin including the unit represented by the formula (1) or (2) may be added in at lest one of the coating liquids A and B.

The cross-linking agent capable of cross-linking the water soluble resin may be also added in at least the coating liquids A and B.

Providing the colorant receiving layer hardened by cross linking described above is preferable from the viewpoint of ink absorbing property and protection of the layer from cracking.

The process above is preferable since the colorants in the ink jet is sufficiently fixed and colored due to a large quantity of the dye mordant present in a desired portion of the colorant receiving layer, and color density, time-dependent blurring, glossiness of the printed portion, water resistance of letters and images after printing, and ozone resistance are improved. A part of the dye mordant may be added in the layer provided at first on the substrate, and the remaining mordant applied thereafter may be the same as or different from the first mordant.

The coating liquid for the colorant receiving layer of the invention (coating liquid A) containing at least the fine particles (for example gas phase silica) and water soluble resin (for example polyvinyl alcohol) is prepared by the following process.

The dispersion solution can be prepared by the steps comprising: adding the fine particles such as the gas phase silica particles and a dispersing agent (may be a cationic resin including the units represented by the formula (1) or (2)) in water in a concentration of the silica fine particles of 10 to 20% by mass; allowing the fine particles to disperse under a high speed rotation at 10,000 rpm (preferably at 5,000 to 20,000 rpm) for 20 minutes (preferably 10 to 30 minutes) using a high speed rotation wet colloid mill (for example, trade name: Clear Mix, manufactured by M technique Co., Ltd.); and dispersing the mixture again by adding an aqueous polyvinyl alcohol (PVA) solution (for example a mass of PVA of about ⅓ of the mass of the gas phase fine particles) under the same dispersion condition described above. Adjusting the pH of the solution to 9.2 with aqueous ammonia, or using a dispersing agent is preferable for stabilizing the coating liquid. The coating liquid obtained is a homogeneous sol, and a porous colorant receiving layer having a three dimensional network structure is formed by coating the sol on the substrate by the method below followed by drying.

The aqueous dispersion composed by the gas phase silica particles and dispersing agent may be prepared by preparing an aqueous dispersion of gas phase silica first followed by adding the aqueous dispersion into an aqueous solution of the dispersing agent. Alternatively, the aqueous solution of the dispersing agent may be added to the aqueous dispersion of gas phase silica, or both solutions may be simultaneously mixed. A gas phase silica powder may be added to the aqueous solution of the dispersing agent, instead of adding the aqueous dispersion of gas phase silica.

An aqueous dispersion containing particles with an average particle diameter of 50 to 300 nm can be obtained by pulverizing the mixed solution using a dispersion machine after mixing the gas phase particles with the dispersing agent. While the dispersion machine available include various conventional dispersion machines such as a high speed rotation dispersion machine, medium stirring dispersion machine (ball mill, sand mill and the like), a ultrasonic dispersion machine, colloid mill dispersion machine and high pressure dispersion machine, the medium stirring dispersion machine, colloid mill dispersion machine and high pressure dispersion machine are preferable for effecting dispersion of coagulated fine particles.

The solvents available in each step are water, organic solvents or mixtures thereof. The organic solvents available for coating include alcohols such as methanol, ethanol, n-propanol, i-propanol and methoxypropanol, ketones such as acetone and methylethyl ketone, tetrahydrofuran, acetonitrile, ethyl acetate and toluene.

A dispersing agent may be added for improving dispersability of the coating liquid. The cationic polymers are preferably used as the dispersing agent.

The proportion of addition of the dispersing agent is preferably 0.1 to 30%, more preferably 1 to 10%, relative to the fine particles.

The coating liquid for the colorant receiving layer may be applied by a method known in the art such as the methods using an extrusion die coater, air doctor coater, bread coater, rod coater, knife coated, squeeze coater, reverse roll coater and bar coater.

While the coating liquid B is applied simultaneously with or after applying the colorant receiving layer coating liquid (coating liquid A), the coating liquid B may be applied before the coated layer after application exhibits a falling rate of drying. In other word, the colorant receiving layer is favorably produced by introducing the coating liquid B while the colorant receiving layer coating liquid (coating liquid A) exhibits a constant rate drying after applying the coating liquid A. A dye mordant may be contained in the coating liquid B.

The phrase "before the coated layer exhibits a falling rate of drying" as used herein usually means a lapse of time of several minutes from immediately after application of the colorant receiving layer coating liquid. The "constant rate drying" phenomenon in which the content of the solvent (dispersion medium) in the applied coating layer is reduced in proportion to the lapse of time appears during this period. The period exhibiting the "constant rate drying" is described in Kagaku Kogaku Binran (Handbook of Chemical Engineering; pp.707-712, Maruzen Co., Ltd., Oct. 25, 1980).

While the colorant receiving layer is dried until the coating layer exhibits a falling rate of drying after applying the coating liquid A, this drying period is usually 0.5 to 10 minutes (preferably 0.5 to 5 minutes) at 40 to 180° C. Although the drying period is naturally different depending on the amount of coating, the range above is usually appropriate.

Examples of the application method before the first coating layer exhibits a falling rate of drying include (1) a method for additionally applying the coating liquid B on the coating layer, (2) a spraying method, and (3) a method for dipping the substrate comprising the coating layer thereon in the coating liquid B.

The method available for applying the coating liquid B in the method (1) include the methods known in the art using a curtain flow coater, extrusion die coater, air doctor coater, bread coater, rod coater, knife coater, squeeze coater, reverse roll coater and bar coater. However, the methods using the extrusion die coater, curtain flow coater and bar coater are preferable since these method is able to apply without making no direct contact on the already formed first coating layer.

The colorant receiving layer is usually heated at 40 to 180° C. for 5 to 30 minutes for drying and hardening after applying the coating liquid B. Heating at 40 to 150° C. for 1 to 20 minutes is particularly preferable.

When the coating liquid B is applied at the same time of applying the colorant receiving layer coating liquid (coating liquid A), the coating liquids A and B are simultaneously applied on the substrate (dual layer application B) so that the coating liquid A contact the substrate, followed by forming the colorant receiving layer by hardening by drying thereafter.

Above-described simultaneous application (dual layer application) can be performed by the coating method using the extrusion die coater, the curtain flow coater, and the like. While the coating layer formed is dried after the simultaneous application, the layer is usually dried by heating at 40 to 150° C. for 0.5 to 10 minutes, preferably at 40 to 100° C. for 0.5 to 5 minutes.

When the coating liquids are applied so as to form a dual layer with the extrusion die coater, for example, the dual layer is formed in the vicinity of the discharge port of the extrusion die coater by simultaneously discharging the two kinds of the coating liquids before being transferred onto the substrate, in order to directly form the dual coating layer. Since the two kinds of the coating liquids in the dual layer before application tends to form cross-links at the interface between the two solutions before being transferred onto the substrate, the two solutions are liable to be thickened by being mixed with each other in the vicinity of the discharge port of the extrusion die coated. Consequently, the application work may be difficult. Accordingly, it is preferable to simultaneously form a triple layer by permitting a barrier layer solution (an intermediate layer solution) to interpose between the two coating liquids A and B.

The barrier layer solution may be selected without any restrictions including, for example, an aqueous solution containing a trace amount of an water soluble resin and water. The water soluble resin is added as a thickener for improving coating performance. Examples of the water soluble resin include cellulose resins (such as hydroxylpropylmethyl cellulose, methyl cellulose and hydroxyethyl cellulose), polyvinyl pyrrolidone and gelatin. The dye mordant may be added to the barrier layer solution.

Surface smoothness, glossiness, transparency and coating layer strength may be improved by applying a calender treatment by passing the film thorough roll nips with heating and compression using a super calender or gross calender machine after the colorant receiving layer is formed on the substrate. However, since the calender treatment above may cause a decrease of the void ratio (or may decrease the ink absorbing property), a condition giving a small degree of decrease of the void ratio should be employed.

The roll temperature for calendering is preferably 30 to 150° C., more preferably 40 to 100° C.

The linear pressure for calendering is preferably 50 to 400 kg/cm, more preferably 100 to 200 kg/cm.

Since the colorant receiving layer is required to have a thickness that renders an absorption capacity enough for absorbing all the ink droplets in ink jet recording, the thickness should be determined in relation to the void ratio in the layer. For example, the thickness should be about 15 μm or more when the amount of the ink is 8 $nL/mm^2$ and the void ratio is 60%.

The thickness of the colorant receiving layer is preferably 10 to 50 μm in ink jet recording considering the conditions above.

The diameter of the void in the colorant receiving layer is, in a media diameter, preferably 0.005 to 0.030 μm, more preferably 0.01 to 0.025 μm.

The void ratio and void median diameter may be measured using a mercury porosimeter (trade name: Pore Sizer 9320-PC2, manufactured by Shimadzu Corporation).

While the colorant receiving layer is preferably excellent in transparency, the haze value thereof is preferably 30% or less, more preferably 20% or less, as a standard when the colorant receiving layer is formed on a transparent film substrate.

The haze value may be measured using a haze meter (trade name: HGM-2DP, manufactured by Suga Test Instrument Co. Ltd.).

A dispersion of polymer fine particles may be added to the constituting layers of the ink jet recording sheet (for example the colorant receiving layer and back layer) of the invention. The polymer fine particles are added for improving the film properties such as size stabilizing property, curl preventive property, adhesion preventive property and cracking preventive property of the film. The polymer fine particles are described in JP-A Nos. 62-245258, 62-131664 and 62-110066. Cracking and curling of the layer may be prevented by adding the polymer fine particles having a low glass transition point (40° C. or less) in the layer containing the dye mordant. Curling may be prevented from occurring by adding a dispersion of the polymer fine particles having a high glass transition point to the back layer.

The ink jet recording layer of the invention may be also produced by the methods described in JP-A Nos. 10-81064, 10-119423, 10-157277, 10-217601, 11-348409, 2001-138621, 2000-43401, 2000-211235, 2000-309157, 2001-96897, 2001-138627, 11-91242, 8-2087, 8-2090, 8-2091 and 8-2093.

EXAMPLES

While the present invention is described in detail hereinafter, the invention is by no means restricted to these examples. "Parts" and "%" in the examples represent "parts by mass" and "% by mass", and "average molecular weight" and "degree of polymerization" denote "mass average molecular weight" and "mass averaged degree of polymerization" unless otherwise stated.

Synthesis Examples

Synthesis Example 1

Dissolved in 195 g of isopropanol were 103.8 parts of 2-(methacryloyloxy)ethyltrimethylammonium chloride, 26.0 parts of styrene and 1.17 parts of 2-mercaptoethanol. The mixture was heated at 70° C. in a nitrogen stream, and 0.373 parts of 2,2'-azobis(2,4-dimethylvaleronitrile) (trade name: V-65, manufactured by Wako Pure Chemical Industries, Ltd.) was added followed by stirring at 70° C. After 2 hours, 0.373 parts of 2,2'-azobis(2,4-dimethylvaleronitrile) (trade name: V-65, manufactured by Wako Pure Chemical Industries, Ltd.) was further added, followed by stirring at 70° C. for 4 hours.

This reaction solution was poured into 3,000 parts of acetone with stirring, and 119 parts of a white solid of [2-(methacryloyloxy)ethyltrimethylamonium chloride]-(styrene) copolymer (polymer 1; I/O value=1.89, cation, equivalent=3.85 meq/g) was obtained by drying the viscous solid formed.

Synthesis Example 2

Obtained by the same method as in Synthesis Example 1 was 110 parts of a white solid of [2-(methacryloyloxy) ethyltrimethylamonium chloride]-(styrene) copolymer (polymer 2; I/O value=1.47, cation equivalent=3.21 meq/g), except that 103.8 parts of 2-(methacryloyloxy) ethyltrimethylammonium chloride and 26.0 parts of styrene in Synthesis Example 1 were changed to 83.1 parts and 41.7 parts, respectively.

Synthesis Example 3

Dissolved in 93 parts of isopropanol were 62.9 parts of dimethylaminoethyl methacrylate and 619 parts of 2-mercaptoethanol. The mixture was heated at 70° C. in a nitrogen stream, and 0.189 parts of 2,2'-azobis(2,4-dimethylvalelonitrile) (trade name: V-65, manufactured by Wako Pure Chemical Industry, Co.) was added to the mixture with stirring at 70° C. After 2 hours, 0.189 parts of 2,2'-azobis(2,4-dimethylvalelonitrile) (trade name: V-65, manufactured by Wako Pure Chemical Industry, Co.) was further added, followed by stirring for 4 hours at 70° C.

Further added in this reaction solution was 55.7 parts of benzyl chloride, and the mixture was stirred at 70° C. for 8 hours.

This reaction solution was poured into 2,000 parts of acetone with stirring, and 98 parts of a white solid of poly-2-(methacryloyloxy)ethyl-N,N-dimethylbenzylammonium chloride (polymer 3; I/O value=1.67, cation equivalent=3.52 meq/g) was obtained by drying the viscous solid formed.

Synthesis Example 4

Dissolved in 135 parts of isopropanol were 55.0 parts of diethylaminoethyl methacrylate, 35.0 parts of methyl methacrylate and 1.08 parts of 2-mercaptoethanol. The mixture was heated at 70° C. in a nitrogen stream, and stirred at 70° C. after adding 0.348 parts of V-65. After 2 hours, 0.348 parts of V-65 was further added, followed by stirring at 70° C. for 4 hours.

Further added in this reaction solution was 48.7 parts of benzyl chloride followed by stirring at 70° C. for 8 hours.

The reaction solution was poured in 2,000 parts of acetone with stirring, and 109 parts of a white solid of [2-(methacryloyloxy)ethyl-N,N-dimethylbenzylammonium chloride]-(methyl methacrylate) copolymer (polymer 4; I/O value=1.46, cation equivalent=2.61 meq/g) was obtained by drying the viscous solid formed.

Synthesis Example 5

Obtained by the same method as in Synthesis Example 4 was 122 parts of a white solid of [2-(methacryloyloxy)ethyl-N,N-dimethylbenzylammonium chloride]-(2-ethylhexyl methyl methacrylate) copolymer (polymer 5; I/O value=1.23, cation equivalent=2.59 meq/g), except that 35.0 parts of methyl methacrylate in Synthesis Example 4 was changed to 34.6 parts of 2-ethylhexyl methacrylate.

Synthesis Example 6

Obtained by the same method as in Synthesis Example 4 was 98 parts of a white solid of [2-(methacryloyloxy)ethyl-N,N-dimethylbenzylammonium chloride]-(styrene) copolymer (polymer 6; I/O value=1.12, cation equivalent=2.57 meq/g), except that 35.0 parts of methyl methacrylate in Synthesis Example 4 was changed to 34.6 parts of styrene.

Synthesis Example 7

Dissolved in 256 parts of isopropanol were 83.1 parts of 2-(methacrylouloxy)ethyltrimethylammonium chloride, and 0.403 parts of 2-mercaptoethanol. The mixture was heated at 70° C. in a nitrogen stream, and 0.198 parts of V-65 was added, followed by stirring at 70° C. for 4 hours. After 2 hours, 0.198 parts of V-65 was further added, followed by stirring at 70° C. for 4 hours.

The reaction solution was poured in 3,000 parts of acetone with stirring, and 78 parts of a white solid of poly-[2-(methacryloyloxy) ethyltrimethylammonium chloride] (polymer 7; I/O value=2.69, cation equivalent=4.81 meq/g) was obtained by drying the viscous solid formed.

Synthesis Example 8

Obtained by the same method as in Synthetic Example 1 was 99 parts of a white solid of [2-(methacryloyloxy) ethyltrimethylammonium chloride]-(styrene) copolymer (polymer 8; I/O value=2.48, cation equivalent=4.6 meq/g), except that 26.0 parts of styrene in Synthesis Example 1 was changed to 5.20 parts of styrene.

Synthesis Example 9

Obtained by the same method as in Synthetic example 1 was 116 parts of a white solid of [2-(methacryloyloxy) ethyltrimethylammonium chloride]-(methyl methacrylate) copolymer (polymer 9; I/O value=2.29, cation equivalent=4.0 meq/g), except that 26.0 parts of styrene in Synthesis Example 1 was changed to 25.0 parts of methyl methacrylate.

Preparation of Samples

Production of Substrate

A wood pulp comprising 100 parts of LBK was beaten to Canadian Standard Freeness of 300 ml with a double disc refiner. Then, 0.5 parts of epoxylated behenic acid amide, 1.0 part of anionic polyacrylamide, 0.1 parts of polyamide polyamine epichlorohydrin and 0.5 parts of cationic polyacrylamide were added in an absolutely dry mass ratio to the pulp. A raw paper sheet with an area density of 170 g/m$^2$ was produced using a Fourdrinier machine.

For adjusting the surface sizing, a fluorescent brightener (trade name: Whitex BB, manufactured by Sumitomo Chemical Co., Ltd.) was added in a proportion of 0.04% to 4% aqueous polyvinyl alcohol solution. The solution was impregnated in the raw paper sheet so that the area density thereof becomes 0.5 g/m$^2$ as converted into an absolute dry mass. A base paper sheet controlled to a density of 1.05 g/cc was obtained by further subjecting to calendering after drying.

After processing the wire face (back face) side of the base paper sheet obtained by corona discharge, high density polyethylene was coated on the surface with a thickness of 19 μm using a melt extruder to form a resin layer with a matte face (the resin layer face is named as a "back face" hereinafter). The back face side was further subjected to corona discharge treatment, and a dispersion prepared by dispersing aluminum oxide (trade name: Alumina Sol 100, manufactured by Nissan Chemical Industries, Ltd.) and silicon dioxide (trade name: SNOWTEX O, manufactured by Nissan Chemical Industries, Ltd.) in a ratio of 1:2 in water was applied in a dry mass density of 0.2 g/m$^2$.

After subjecting a felt face (surface) having no resin layer to corona discharge treatment, low density polyethylene, which contains 10% of titanium dioxide of the anatase type, a trace amount of ultramarine, and 0.01% of the fluorescent brightener relative to polyethylene, with a melt flow rate (MFR) of 3.8 was extruded thereon with a thickness of 29 μm using a melt extruder, thereby producing a substrate having a highly glossy thermoplastic resin layer formed on the surface side of the base paper sheet (the highly glossy face is called as a top surface hereinafter).

Example 1

(Preparation of Colorant Receiving Layer Coating Liquid A)

Gas phase silica fine particles, ion-exchange water and polymer 1 were mixed and dispersed using a high speed rotation colloid mill (trade name: KD-P, manufactured by Shinmaru Enterprises Corporation), and the colorant receiving layer coating liquid A was prepared by adding polyvinyl alcohol, boric acid, polyoxyethylene laurylether and ion-exchange water in a proportion shown below.

The mass ratio between the silica fine particle and water soluble resin (PB ratio=silica fine particles/polyvinyl alcohol) was 4.5, and the colorant receiving layer coating liquid A was acidic with a pH value of 3.5.

Composition of Colorant Receiving Layer Coating Liquid A:

Gas phase silica fine particles (inorganic fine particles, average primary particle diameter: 7 nm, trade name:

| | |
|---|---|
| Rheoseal QS-30, manufactured by Tokuyama Corp.) | 10.0 parts |
| Ion-exchange water | 50.6 parts |
| Polymer 1 (25% aqueous solution) | 2.0 parts |
| Polyvinyl alcohol (water soluble resin) 8% aqueous solution (trade name: PVA 124, manufactured by Kuraray Co., Ltd., degree of saponification: 98.5%, degree of polymerizaton: 2400) | 27.8 parts |
| Boric acid (cross-linking agent) | 0.4 parts |
| Polyoxyethylene lauryl ether (surfactant) 10% aqueous solution (trade name: Emulgen 109P, made by Kao Corporation, HLB: 13.6) | 1.2 parts |
| Ion-exchange water | 33.0 parts |

Production of ink-jet recording sheet

After subjecting the top surface of the substrate to corona discharge treatment, the colorant receiving layer coating liquid A obtained as described above was applied on the top surface of the substrate in a coating ratio of 200 ml/m$^2$ using an extrusion die coater (coating step), and the coating layer was dried so that the solid contents density of the coating layer becomes 20% at 80° C. using a hot air dryer (air speed 3 to 8 m/sec). The coating layer showed a constant falling rate of drying during this drying period. A dye mordant was adhered on the coating layer at a density of 20 g/m$^2$ by immersing in mordant solution B having the composition below for 30 seconds (mordant solution adhering step), followed by drying at 80° C. for 10 minutes (drying step). The ink jet recording sheet (1) of the invention having the colorant receiving layer with a dry thickness of 32 μm was thus produced.

Composition of Mordant Coating Liquid B:

| | |
|---|---|
| Boric acid (cross-linking agent) | 0.65 parts |
| 20% Aqueous solution of polyallyamine mordant (trade name: PAA-03, manufactured by Nittobo Co.) | 12.5 parts |
| Ion-exchange water | 72.0 parts |
| Ammonium chloride (surface pH control agent) | 0.8 parts |
| 2% Aqueous solution of polyoxyethylene laurylether (surfactant) (trade name: Emulgen 109P, manufactured by Kao Corporation, HLB = 13.6) | 10 parts |
| 10% Aqueous solution of fluorine surfactant (trade name: MEGAFAC-F1405 manufactured by Dainippon Ink and Chemicals, Incorporated) | 2.0 parts |

Examples 2 to 6

The ink jet recording sheets of the invention (2) to (6) of the invention were produced by the same method as in Example 1, except that the polymer 1 in the "composition of the colorant receiving layer coating liquid A" in Example 1 was changed to the same quantity of respective polymers 2 to 6.

Example 7

The ink jet recording sheet (7) of the invention was produced by the same method as in Example 1, except that 0.63 parts of basic aluminum oxide ($Al_2(OH)_5Cl$ trade name:

PAC#1000, manufactured by Taki Chemical Co., Ltd.) was further added in the "composition of colorant receiving layer coating liquid A" in Example 1.

Example 8

The ink jet recording sheet (8) of the invention was produced by the same method as in Example 1, except that 0.6 parts of zirconyl acetate (30% aqueous solution) was further added in the "composition of colorant receiving layer coating liquid A" in Example 1.

Example 9

The ink jet recording sheet (9) of the invention was produced by the same method as in Example 2, except that 12.5 parts of the 20% aqueous polyallylamine mordant (trade name: PAA-03, made by Nittobo Co.) solution in the "composition of colorant receiving layer coating liquid B" in Example 2 was changed to 12.5 parts of 10% aqueous ammonia solution.

Comparative Example 1

The ink jet recording sheet (10) was produced by the same method as in Example 1, except that the polymer 1 in the "composition of colorant receiving layer coating liquid A" in Example 1 was changed to poly(diallyldimethylammonium chloride (trade name: Sharol DC-9020, manufactured by Daiichi Kogyo Seiyaku Co., Ltd.; polymer 10).

Comparative Examples 2 to 4

The ink jet recording sheets (11) to (13) were produced by the same method as in Example 1, except that the polymer 1 in the "composition of colorant receiving layer coating liquid A" in Example 1 was changed to corresponding polymers 7 to 9.

Evaluation

The ink jet recording sheets (1) to (9) of the invention, and the comparative ink jet recording sheets (10) to (13) were evaluated with respect to the following items. The results are shown in Table 1 below.

Evaluation of Ink Absorbing Ability

Solid images of Y (yellow), M (magenta), C (cyan), K (black), B (blue), G (green) and R (red) were printed on each ink jet recording sheet obtained above using an ink jet printer (trade name: PM-900C, manufactured by Seiko Epson Corporation). Immediately after printing (10 seconds after), a sheet of paper was allowed to contact each image by compression to observe transfer of the ink to the paper sheet, and the degree of transfer was evaluated by the following criteria by the naked eye. No transfer of the ink on the paper sheet indicates that the ink absorption rate is excellent.

A: Transfer of the ink on the paper sheet was not observed at all;

B: A part of the ink was transferred onto the paper sheet; and

C: A considerable amount of the ink was transferred onto the paper sheet.

Evaluation of Time-dependent Blurring

A lattice-shaped linear pattern (0.28 nm) having adjoining magenta ink lines and black ink lines was printed on each ink jet recording sheet using the ink jet printer (trade name: PM-900C, manufactured by Seiko Epson Corporation), and the pattern was measured with a reflection densitometer (trade name: Xrite 310, manufactured by X-Rite Incorporated.). After the measurements, each ink jet recording sheet was inserted into a clear file holder and, after preserving the sheet in a constant temperature/constant humidity chamber at 35° C. with a humidity of 80% for three days, the visual density (OD thermo) was measured again to calculate the rate of change of the density [(OD thermo/OD fresh)×100]. Density changes of less than 140%, 140 to 160% and 160% or more were evaluated as A, B and C, respectively. The smaller rate of change of the density shows that the recording sheet has a smaller degree of time-dependent blurring (good).

Evaluation of Light Fastness

Solid images of magenta and cyan were printed on each recording sheet using the ink jet printer (trade name: PM-900C, manufactured by Seiko Epson Corporation). Subsequently, a light from a lamp was irradiated through a filter for cutting UV light in a wavelength region of 365 nm or less in an environment of 25° C. at a relative humidity of 32% for 3.8 hours. Then, the recording sheet was allowed to leave in an environment of 20° C. at a relative humidity of 91% for 1 hour while the lamp was turned off. This cycle was repeated for 168 hours using Xenon Weatherometer Ci65A (trade name, manufactured by ATLAS Co.). The image densities of each color image before and after the test were measured with the reflection densitometer (trade name: Xrite 310, manufactured by X-Rite Incorporated.) to calculate the residual ratio of each color density.

A residual ratio of 90% or more was evaluated as A, a residual ratio of 80% or more and less than 90% was evaluated as B, a residual ratio of 70% or more and less than 80% was evaluated as C, and a residual ratio of less than 70% was evaluated D.

TABLE 1

| | Recording sheet | Polymer | Ink absorbing property | time-dependent blurring | Light fastness |
|---|---|---|---|---|---|
| Example 1 | 1 | 1 | A | B | B |
| Example 2 | 2 | 2 | A | A | B |
| Example 3 | 3 | 3 | A | B | B |
| Example 4 | 4 | 4 | A | B | B |
| Example 5 | 5 | 5 | A | A | B |
| Example 6 | 6 | 6 | A | A | B |
| Example 7 | 7 | 1 | A | A | B |
| Example 8 | 8 | 1 | A | A | B |
| Example 9 | 9 | 1 | A | B | B |
| Comparative example 1 | 10 | 10 | A | C | B |
| Comparative example 2 | 11 | 7 | A | C | B |
| Comparative example 3 | 12 | 8 | A | C | B |
| Comparative example 4 | 13 | 9 | A | C | B |

The results in Table 1 show that the ink jet recording sheets (Examples 1 to 9) are excellent in image stability since blurring is suppressed under high temperature/high humidity conditions.

The ink jet recording sheets of the invention were also excellent in glossiness, ink absorbing speed, image density and water resistance.

In contrast, the comparative ink jet recording sheets produced without using the polymer of the invention could not suppress blurring from occurring under the high temperature/high humidity conditions.

Accordingly, the invention provides an ink jet recording sheet being free from cracks while having a good ink absorbing property with an excellent image density. The imaging part is excellent in light fastness and water resistance without generating time-dependent blurring during a long term storage in a high temperature/high humidity environment.

What is claimed is:

1. An ink jet recording sheet comprising a colorant receiving layer disposed on a substrate, wherein the colorant receiving layer comprises fine particles, a water soluble resin, and a cationic resin including a unit represented by the following formula (1) and a cationic resin including a unit represented by the following formula (2):

Formula (1)

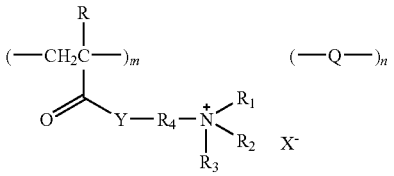

Formula (2)

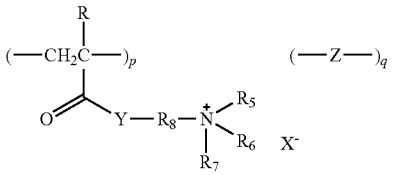

wherein in the formula (1), R represents a hydrogen atom or a methyl group; Y represents a divalent linking group; $R_1$ represents an optionally substituted aralkyl or aryl group; $R_2$ and $R_3$ each independently represent an optionally substituted alkyl, aralkyl or aryl group having 1 to 18 carbon atoms; $R_4$ represents an optionally substituted alkylene, aralkylene or arylene group; Q is at least one unit provided from a monomer having an ethylenic double bond, and represents a unit having an inorganic/organic ratio (I/O value) of less than 1 in an organic conceptional chart; $X^-$ represents an anion; m represents 20 to 100% by mole; and n represents 0 to 80% by mole; and in the formula (2), R represents a hydrogen atom or a methyl group; Y represents a divalent linking group; $R_5$, $R_6$ and $R_7$ each independently represent an optionally substituted alkyl group having 1 to 18 carbon atoms; $R_8$ represents an optionally substituted alkylene, aralkylene or arylene group; Z is at least one unit provided from an aromatic group-containing monomer having an ethylenic double bond, and represents a unit having less than 0.5 of an inorganic/organic ratio (I/O value) in the organic conceptional chart; $X^-$ represents an anion; p represents 20 to 80% by mole; and q represents 20 to 80% by mole, wherein the monomer that provides the unit represented by Q in the formula (1) is styrene or vinyl toluene, the monomer that provides the unit represented by Z in the formula (2) is styrene or vinyl toluene, the I/O value of the cationic resin represented by the formula (1) is not more than 2 with a cation equivalent of at least 1.5 meq/g or more and no more than 4 meq/g, and the I/O value of the cationic resin represented by formula (2) is not more than 2 with a cation equivalent of at least 1.5 meq/g or more and no more than 4 meq/g; and wherein the unit Q in the formula (1) represents a vinyl toluene.

2. An ink jet recording sheet according to claim 1, wherein the fine particles are at least one selected from silica fine particles, colloidal silica, alumina fine particles and pseudo-boehmite.

3. An ink jet recording sheet according to claim 1, wherein the water soluble resin is at least one selected from polyvinyl alcohol resins, cellulose resins, resins having ether bonds, resins having carbamoyl groups, resins having carboxyl groups and gelatin.

4. An ink jet recording sheet according to claim 1, wherein the colorant receiving layer comprises a cross-linking agent capable of cross-linking the water soluble resin.

5. An ink jet recording sheet according to claim 1, wherein the colorant receiving layer further comprises a dye mordant.

6. An ink-jet recording sheet according to claim 1, wherein the colorant receiving layer is obtained by crosslinking a coated layer prepared by coating the substrate with a coating liquid containing at least the fine particles, the water soluble resin, and a cationic resin including a unit represented by the formula (1) and optionally a cationic resin including a unit represented by the formula (2), and the coated layer is hardened by cross-linking by adding a cross-linking agent to at least one of the coating liquid and a basic solution having a pH value of at least 8, and by applying the basic solution to the coated layer (1) at the same time as when the coated layer is formed by applying the coating liquid or (2) during the process for drying the coated layer formed by applying the coating liquid, and before the coated layer exhibits a falling rate of drying.

7. An ink jet recording sheet according to claim 1, wherein Y represents —O— or —NR'—, in which R' represents hydrogen or an alkyl group.

8. An ink jet recording sheet according to claim 1, wherein m in formula (1) represents 30 to 70% by mole, and n in formula (1) represents 30 to 70% by mole.

9. An ink jet recording sheet according to claim 1, wherein p in formula (2) represents 30 to 70% by mole, and q in formula (2) represents 30 to 70% by mole.

10. An ink jet recording sheet according to claim 1, wherein the weight average molecular weight of the cationic resin is in the range of from 2,000 to 100,000.

11. An ink jet recording sheet according to claim 1, wherein the total content of the cationic resins is in the range of from 0.1 to 3 $g/m^2$.

* * * * *